US010787810B2

(12) United States Patent
Bergollo et al.

(10) Patent No.: US 10,787,810 B2
(45) Date of Patent: Sep. 29, 2020

(54) BUILDING BLOCK SYSTEM OF PREFABRICATED NON-MASONRY MORTARLESS INTERLOCKING BUILDING BLOCKS WITH CAP ATTACHMENTS

(71) Applicants: Harry Bergollo, Miami, FL (US); Joel Corbea, Miami, FL (US); Jason Reed Struble, Lantana, FL (US)

(72) Inventors: Harry Bergollo, Miami, FL (US); Joel Corbea, Miami, FL (US); Jason Reed Struble, Lantana, FL (US)

( * ) Notice: Subject to any disclaimer, the term of this patent is extended or adjusted under 35 U.S.C. 154(b) by 51 days.

(21) Appl. No.: 16/240,753

(22) Filed: Jan. 6, 2019

(65) Prior Publication Data

US 2020/0217066 A1 Jul. 9, 2020

(51) Int. Cl.

| | |
|---|---|
| ***E04B 2/00*** | (2006.01) |
| ***E04B 2/18*** | (2006.01) |
| ***E01C 5/00*** | (2006.01) |
| ***E04B 2/24*** | (2006.01) |
| ***E04C 2/20*** | (2006.01) |
| *E04B 2/02* | (2006.01) |

(52) U.S. Cl.

CPC ..... *E04B 2/18* (2013.01); *E01C 5/005* (2013.01); *E04B 2/24* (2013.01); *E04C 2/20* (2013.01); *E04B 2002/0213* (2013.01); *E04B 2002/0239* (2013.01); *E04B 2002/0295* (2013.01)

(58) Field of Classification Search

None

See application file for complete search history.

(56) References Cited

U.S. PATENT DOCUMENTS

| | | | | | |
|---|---|---|---|---|---|
| 1,807,138 | A * | 5/1931 | Spelshouse | E04B 2/42 | 52/606 |
| 1,822,820 | A * | 9/1931 | Munson | E04B 2/16 | 52/436 |
| 1,850,884 | A * | 3/1932 | Kissinger | E04B 2/14 | 52/608 |
| 1,884,319 | A * | 10/1932 | Smith | E04B 2/42 | 52/405.2 |
| 1,913,638 | A * | 6/1933 | Raftis | E04B 2/42 | 52/375 |
| 1,959,816 | A * | 5/1934 | Crum | E04B 2/14 | 52/98 |
| 1,968,393 | A * | 7/1934 | Henderson | E04B 2/14 | 52/98 |
| 2,134,637 | A * | 10/1938 | Loucks | E04B 2/42 | 52/503 |
| 3,609,926 | A * | 10/1971 | Muse | E04B 2/44 | 52/439 |
| 3,618,279 | A * | 11/1971 | Sease | E04B 2/46 | 52/223.7 |

(Continued)

*Primary Examiner* — Basil S Katcheves

(57) ABSTRACT

A building block system of a plurality of transportable, lightweight, and reusable hollow prefabricated non-masonry interlocking mortarless building blocks that have corresponding mating formations being protuberances and concavities that run vertically up the building blocks being joined together and when aligned in a staggered manner upwardly are held together with threaded reinforcement rods extending vertically between and connected to the top and bottom channels through connectable couplings and capped off with complementary cap attachments.

1 Claim, 37 Drawing Sheets

(56) References Cited

U.S. PATENT DOCUMENTS

| | | | | | |
|---|---|---|---|---|---|
| 5,826,394 | A * | 10/1998 | Barton, Jr. | A63H 33/044 | 52/592.1 |
| 6,000,186 | A * | 12/1999 | Fielding | E04B 2/18 | 52/396.08 |
| 8,266,855 | B1 * | 9/2012 | Altararwah | E04B 2/08 | 52/275 |
| 8,671,640 | B1 * | 3/2014 | Thomas | E04B 2/18 | 446/122 |
| 10,287,732 | B1 * | 5/2019 | Warford | E01C 5/005 | |
| 2005/0284092 | A1 * | 12/2005 | Meyer | E04B 2/18 | 52/747.1 |
| 2014/0150361 | A1 * | 6/2014 | Castonguay | E04B 2/26 | 52/309.4 |

* cited by examiner

BUILDING BLOCK SYSTEM OF PREFABRICATED NON-MASONRY MORTARLESS INTERLOCKING BUILDING BLOCKS WITH CAP ATTACHMENTS

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The technical field of the invention is building units and construction elements in that the present invention is a building block system of individual hollow prefabricated non-masonry mortarless interlocking building blocks with corresponding cap attachments that may be used to construct partitions, walls, buildings, and other structures.

Many types of building blocks or construction modules, including bricks made of clay, cinder blocks made of concrete, and non-masonry interlocking mortarless building blocks made of polymer plastic, have been used in the past to build permanent and temporary walls and structures.

Prior known non-masonry interlocking mortarless building blocks come in various sizes for accommodating prescribed wall dimension lengths and openings, have connecting elements at opposite ends and connecting members at the top and bottom faces of the blocks, and include features for building interconnecting right-angle walls. Many non-masonry interlocking mortarless building blocks use some arrangement of tongue and groove, dovetail, sliding spline, or other male and female members. Some blocks also rely on precise geometrical dimensions to position blocks relative atop each other. And it has been long recognized that use of interlocking building blocks without the need of mortar results in rapid construction of walls even when using unskilled labor. Hence, building blocks having male and female interlocking members have been used for some time in an attempt to reduce the amount of labor required to construct walls, partitions, and other structures.

U.S. Pat. No. 1,892,605 "Wall Construction" (Betzler, 1932) provides a series of interlocking components to facilitate constructing a hollow wall structure. The hollow wall may, optionally, be filled with concrete, the interlocking block wall constituting a lost form.

U.S. Pat. No. 2,684,589 "Interlocking hollow building block" (Arnold, 1954) discloses an interlocking hollow building block where the hollow blocks are later filled with wet concrete or the like in order to form a substantially integral structure.

U.S. Pat. No. 3,410,044 "Foamed Plastic Based Construction Elements" (Moog, 1968) provides construction elements that may be stacked and then, optionally, be filled with concrete. Interlocking blocks are optionally provided by Moog.

U.S. Pat. No. 3,618,279 "Modular building materials" (Sease, 1971) discloses an interlocking type of building block having a hollow truncated pyramidal projection extending upwardly from the body of the block, and a cavity within a block so formed as to receive such a projection from a block in an adjacent lower course, such a block being designed so that it is easily manufactured without requiring close tolerances.

U.S. Pat. No. 4,075,808 "Building Construction System Using Mortar-Less Modular Building Block Elements" (Pearlman, 1978) teaches another set of interlocking form blocks useful for laying up a modular form for filling.

U.S. Pat. No. 5,311,718 "Form For Use In Fabricating Wall Structures And A Wall Structure Fabrication System Employing Said Form" (Trousilek, 1994) discloses a plastic prefabricated form system.

U.S. Pat. No. 4,924,641 "Polymer Building Wall Form Construction" (Gibbar, Jr., 1990) teaches a polymer building wall form wherein forms prefabricated of polymer are assembled together, spaced apart by integrally connecting polymer or blocks or spacers and erected upon a foundation footing through their insertion upon L-shaped ties.

U.S. Pat. No. 5,490,362 "Hollow block system" (Mercier & Camille, 1996) discloses a hollow block system having mating interconnecting elements extending transversely in rows and slidable in each other upon transversal displacement.

U.S. Pat. No. 6,161,357 "Bidirectionally interlocking, hollow brick wall system" (Altemus, 2000) discloses a bidirectionally interlocking, hollow wall system comprising an assembly of bricks. The bricks of this invention can be reinforced with rods or posts or filled with concrete or both. And bricks of this invention can be assembled at other than right angles at the corners.

U.S. Pat. No. 7,694,485 "Mortarless interlocking building block for a building block system" (Siener, 2010) discloses a mortarless interlocking building block for a building block system comprising a single light-weight block of the standard building block dimensions molded from plastic and configured to be separable into three-quarter, half and one-quarter sizes for accommodating prescribed wall dimension lengths and openings, including a feature for building interconnecting right-angle walls.

Finally, U.S. Pat. No. 8,074,419 "Unbonded non-masonry building block components" (Humphress & Flinchum, 2011) discloses non-masonry building block components made of polymer plastic that are reusable and provide integrated horizontal and vertical hollows for outfitting permanent or temporary structures with both electrical wiring and plumbing while leaving both the external and internal surfaces of the finished structure aesthetically pleasing.

There are several problems with the prior art. Most heretofore known blocks for mortarless interlocking block systems are costly to produce, and the building blocks cannot be assembled at other than right angles at the corners. In addition, most known non-masonry interlocking mortarless hollow building blocks are not reusable because they are filled with wet concrete or another type of permanent, field-applied filling to form a substantially integral structure. And most prior known non-masonry interlocking mortarless building blocks must be clean when being assembled into a wall; otherwise, the blocks will not interlock successfully, causing the structure built to be unstable. In most instances, the dimensions to which non-masonry interlocking building blocks have been designed do not allow enough space between the building blocks to account for expansion and shrinking of the building blocks when exposed to extreme hot and cold temperatures. This may cause deterioration of a structure built from such blocks.

Proposed solutions for prefabricated modular building blocks of related art that does not require the use of a mortar mixture do not offer satisfactory levels of inexpensiveness, firmness, strength, stability, durability, re-usability, and transportability.

Thus, it is desirable to have individual hollow prefabricated non-masonry mortarless interlocking building blocks that enable unskilled laborers to build structures that are quickly and easily erected, disassembled, and used again, yet retain desirable strength and durability over time.

Accordingly, the objective of the present invention is a system of prefabricated non-masonry mortarless interlocking building blocks that may be easily shipped to a site and combined together with metal bars by relatively untrained personnel in order to quickly erect and disassemble partitions, walls, and other structures during times of military, emergency, humanitarian, and disaster relief efforts.

None of the patents and published patent applications, taken singly, or in any combination are seen to teach or suggest the novel building block system of prefabricated non-masonry mortarless interlocking building blocks.

BRIEF SUMMARY OF THE INVENTION

The purpose of the present embodiment of the invention is quick and inexpensive construction of partitions, walls, or other structures during times of military, emergency, humanitarian, and disaster relief efforts. In addition to the present invention, there is provided a method of using the Building Blocks and Cap Attachments to assemble partitions, walls, or other structures.

Eleven Building Blocks and four Cap Attachments make up the building block system. The building blocks are: Full End Block with Female Joint; Half End Block with Female Joint; Full Corner Block with Female Joint and Offset Male Corner; Full Block with Female to Male Joint; Full End Block with Male Joint; Half End Block with Male Joint; 45-degree Angle Half Block with Female to Male Joint; 45-degree Angle Full Block with Female to Male Joint; Full Corner Block with Male Joint and Offset Female Corner; Half Corner Block with Male Joint and Offset Female Corner; and Half Block with Female to Male Joint.

The presently preferred embodiment of the eleven Building Blocks and four Cap Attachments is polymer plastic; however, any other composite materials that are sufficiently lightweight, rigid, and strong enough to receive and retain a field-applied, removable fill such as sand and dirt will suffice. Being manufactured out of polymer plastic or any other composite materials makes the Building Blocks and Cap Attachments easily transportable and reusable.

Each Building Block has an open top portion in order to receive a field-applied removable fill, such as sand or dirt. Each Building Block has one or more guide conduit orifices in its bottom portion allowing for the vertical insertion of a threaded rod through a series of Building Blocks stacked upwardly; the threaded rods are connected together by threaded couplings. The vertical insertion of threaded rods addresses upward lift problems and enhance the strength of a wall assembled from a series of complementary Building Blocks. The vertical reinforcement provided by the threaded rods provides structural integrity when Building Blocks are stacked upwards in a staggered manner upon each other. Each threaded rod connected together by a threaded coupling is removable.

Each Building Block has either a male or female mating formation, or both. The male and female mating formations are French dovetail joints that run vertically up the two Building Blocks being joined. The male mating formation is a curved protuberance. The female mating formation is a concavity. The male and female mating formations have specialized grooves that provide horizontal interlocking capability. The male and female mating formations are designed to self-align and level interlocked Building Blocks with each other. The male and female mating formations offer resistance to traction and compression. The lack of necessity for adhesives allows the Building Blocks to be quickly utilized in any environment or climate conditions without the need to wait for bonding agents to dry or set. Without bonding agents, a more readily useable product is produced for the untrained consumer while limiting the amount of on-site materials and time spent building a structure.

The four Cap Attachments are: Full Block Cap Attachment; Half Block Cap Attachment; 45-degree Angle Half Block Cap Attachment; and 45-degree Angle Full Block Cap Attachment.

Each Cap Attachment caps off correspondingly shaped Building Blocks by snapping onto the top of the Building Block after it is filled with a removable substance. Each of the four Cap Attachments are designed to connect to correspondingly shaped Building Blocks by inserting a pin through each access port located on the front face portion and rear face portion of the correspondingly shaped Building Blocks. And each of the four Cap Attachments has a top portion where there is located one or more guide conduit orifices that cooperate to receive a threaded rod vertically inserted downward through a series of Building Blocks stacked upwardly in addition to two square shaped footers that align the Building Blocks as each is stacked upwardly upon another other.

The plurality of hollow prefabricated, non-masonry, mortarless, interlocking Building Blocks with four complementary Cap Attachments of the building block system are configured to allow for several advantages.

One advantage of the present embodiment of the invention to that it allows for the quick and inexpensive construction of strong partitions, walls, or other temporary structures during times of military, emergency, humanitarian, and disaster relief efforts. Each Building Block is designed so that it is cheaply and easily manufactured without requiring close tolerances. The Building Blocks of this invention are reinforced with threaded rods that provide a stronger wall once a plurality of Building Blocks are assembled. The ease of assembly and disassembly of a wall while maintaining the structural integrity of the Building Blocks for future use is particularly useful to military, emergency, humanitarian, and disaster relief efforts that often need fast, temporary structures that can be removed without demolition equipment.

A second advantage of the present embodiment of the invention is that its being made of polymer plastic or any other composite materials makes the Building Blocks and Cap Attachments transportable, durable, and reusable.

A third advantage of the present embodiment of the invention is that the Building Blocks can be interconnected, assembled, and aligned to create walls or structures with a variety of types of angles, including 90-degree angles and other than right angles.

DETAILED DESCRIPTION OF THE INVENTION

The detailed description set forth below is intended as a description of the presently preferred embodiment of the invention and is not intended to represent the only form in which the present invention may be constructed or utilized. The description sets forth the functions and sequences of steps for constructing and operating the invention. It is to be understood, however, that the same or equivalent functions and sequences may be accomplished by different embodiments and that they are intended to be encompassed within the scope of the invention.

The present embodiment of the invention is a building block system of eleven hollow prefabricated, non-masonry, mortarless, interlocking building blocks with complementary cap attachments that are designed to interconnect and be stacked vertically upon one another. All blocks and cap attachments preferably should be made of polymer plastic or any other composite materials that are sufficiently lightweight, rigid, and strong enough to be capable of receiving and retaining a field-applied, removable fill such as sand or dirt.

Figure 1:
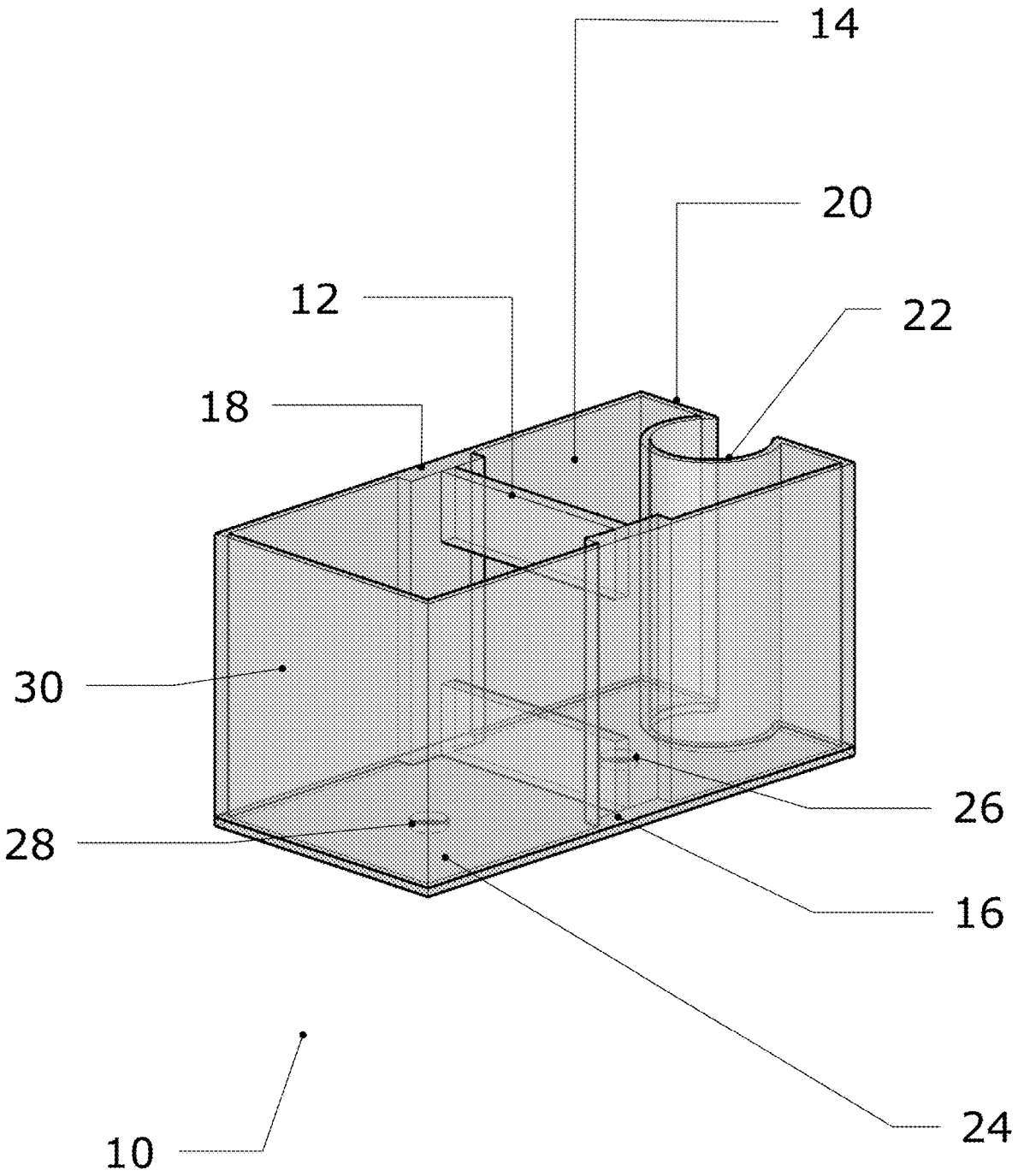
FIG. 1 is a perspective view of a Full End Block with Female Joint.
Figure 2:
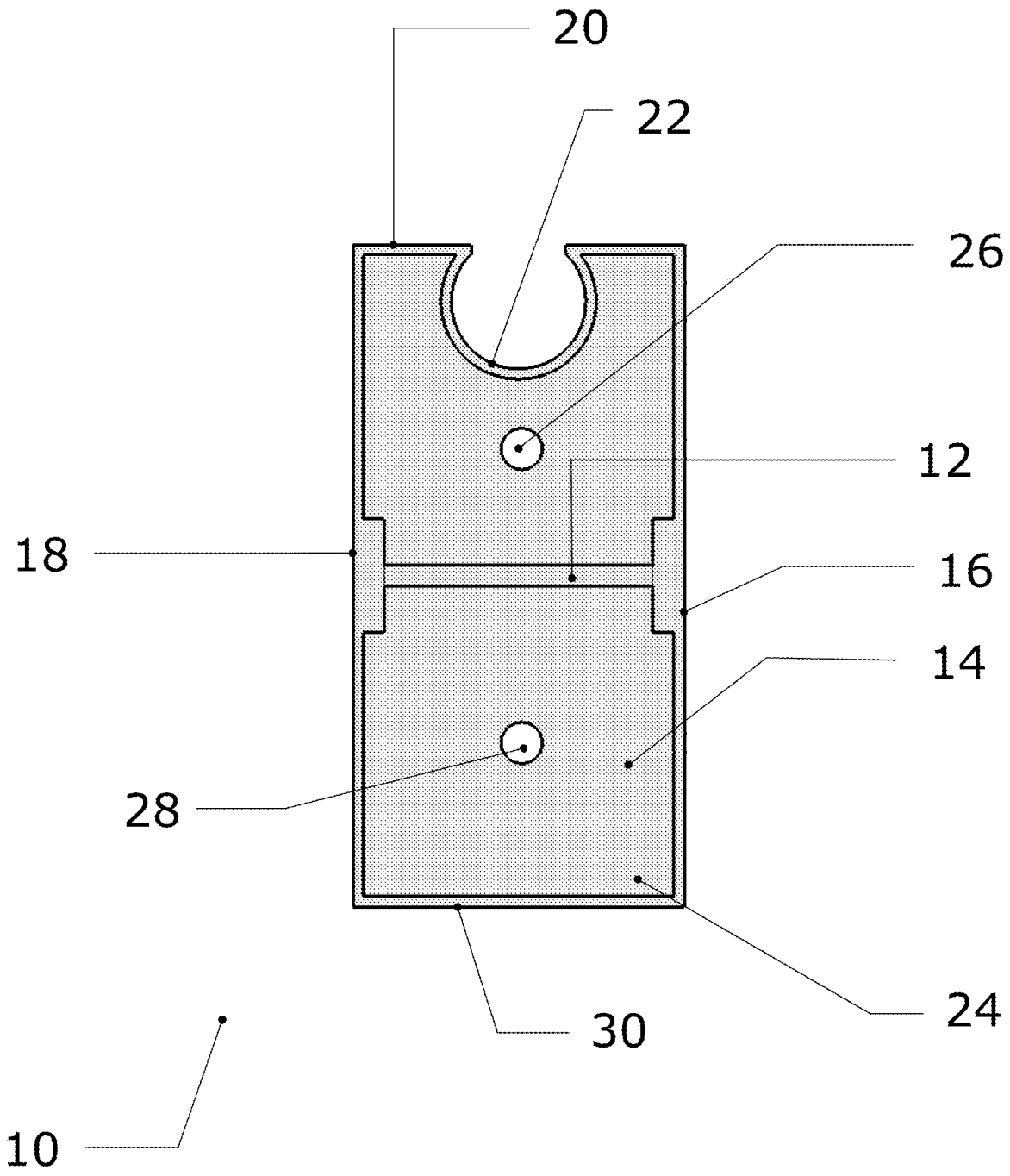
FIG. 2 is a top view of a Full End Block with Female Joint.

FIGS. 1 and 2 illustrate a Full End Block with Female Joint 10 which is the first element of the building block system invention.

FIG. 1 illustrates a perspective view of a Full End Block with Female Joint 10 and depicts a hollow rectangular form that has eight 90-degree vertices.

The Full End Block with Female Joint 10 may be made in any dimension suitable for the building it will be forming. In the preferred embodiment, the Full End Block with Female Joint 10 is eight inches wide, eight inches high, and sixteen inches long. In other embodiments, the Full End Block with Female Joint 10 has dimensions of two times as long as its width and one eighth as thick as its length.

The Full End Block with Female Joint 10 consists of an open top portion 14 with stiffener bars 12 bisecting the block and connecting the unornamented front face portion 16 and the unornamented rear face portion 18; a bottom portion 24 that is flat and closed with the exceptions of one guide conduit orifice 26 located near the first end portion 20, and one guide conduit orifice 28 located near the unornamented second end portion 30; an unornamented front face portion 16; an unornamented rear face portion 18; a first end portion 20 that has one female mating formation 22 being a concavity; and an unornamented second end portion 30. The unornamented second end portion 30, the unornamented front face portion 16, and the unornamented rear face portion 18 are smooth flat planar surfaces.

FIG. 2 illustrates a top view of a Full End Block with Female Joint 10 and shows a female mating formation 22 that is a concavity running vertically up the first end portion 20. In the preferred embodiment, the Full End Block with Female Joint 10 has a female mating formation 22 that is a concavity with a radius of one and five-eighths inches running vertically up the first end portion 20. In other embodiments, the Full End Block with Female Joint 10 has a concavity with a radius sufficient to couple with male mating formations that are corresponding protuberances running vertically up portions of other blocks. In all embodiments of the Full End Block with Female Joint 10, the mating formations are designed so that the coupling is reversible, thereby making the block reusable.

FIG. 2 further illustrates that the Full End Block with Female Joint 10 has one stiffener bar 12 bisecting the open top portion 14 and connecting the unornamented front face portion 16 and the unornamented rear face portion 18, thereby providing structural integrity to the block. In all embodiments of the Full End Block with Female Joint 10, the stiffener bars are of sufficient thickness to prevent local buckling and ensure stability.

FIG. 2 also illustrates that the Full End Block with Female Joint 10 has a bottom portion 24 that is closed with the exceptions of two guide conduit orifices 26 and 28, each of which cooperates to receive one or more threaded rods which pass vertically through the guide conduit orifices in order to align and reinforce the blocks so structural integrity is maintained when a series of blocks are stacked upwardly upon each other while building structures. In the preferred embodiment of the Full End Block with Female Joint 10, the guide conduit orifices 26 and 28 have a diameter of one and one-fourth inches. In all embodiments of the Full End Block with Female Joint 10, the diameter of the guide conduit orifices 26 and 28 are somewhat larger that the diameter of the threaded rod so that the threaded rod can be inserted through the guide conduit orifices 26 and 28 with some tolerance.

Figure 3:
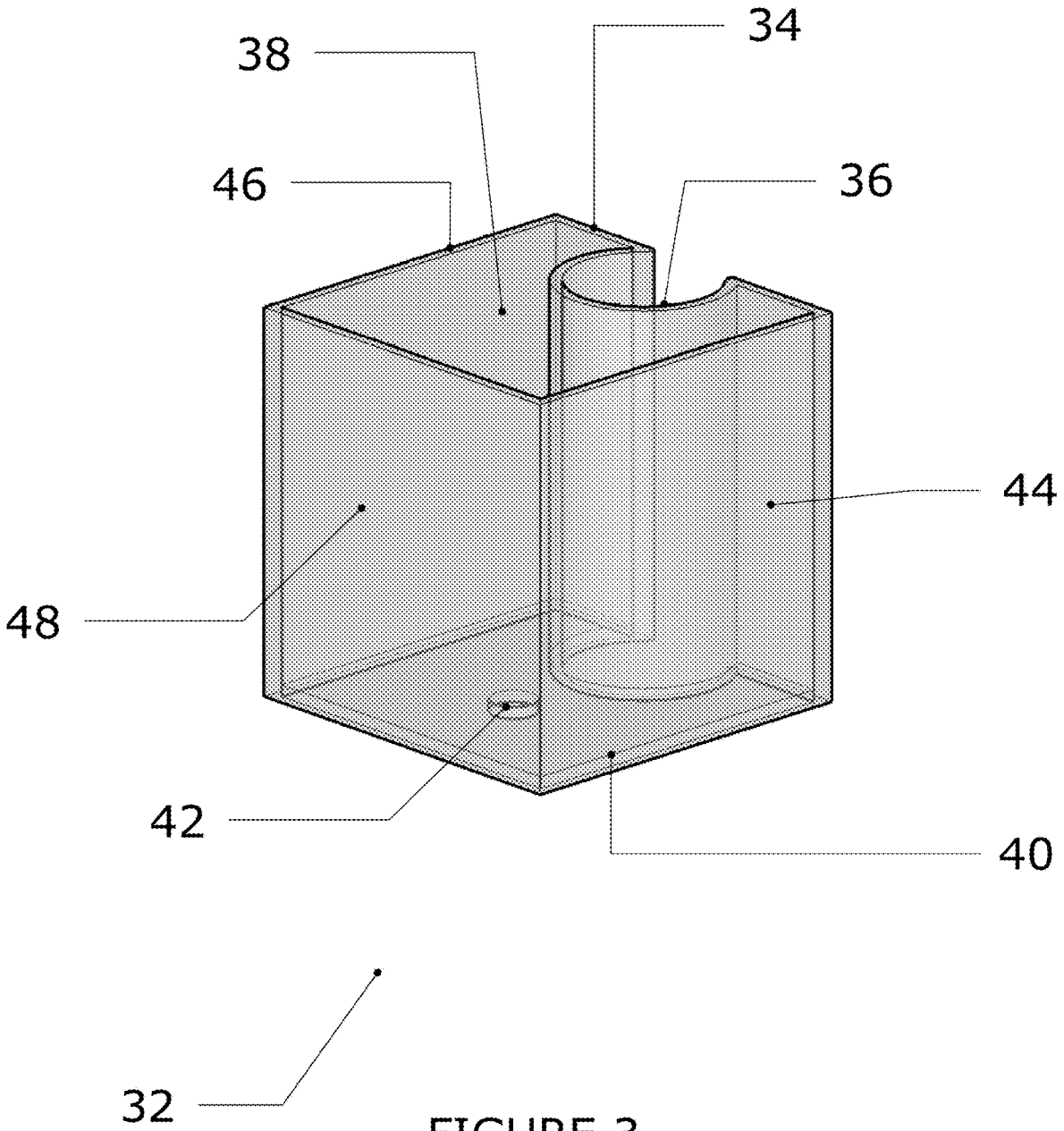
FIG. 3 is a perspective view of a Half End Block with Female Joint.
Figure 4:
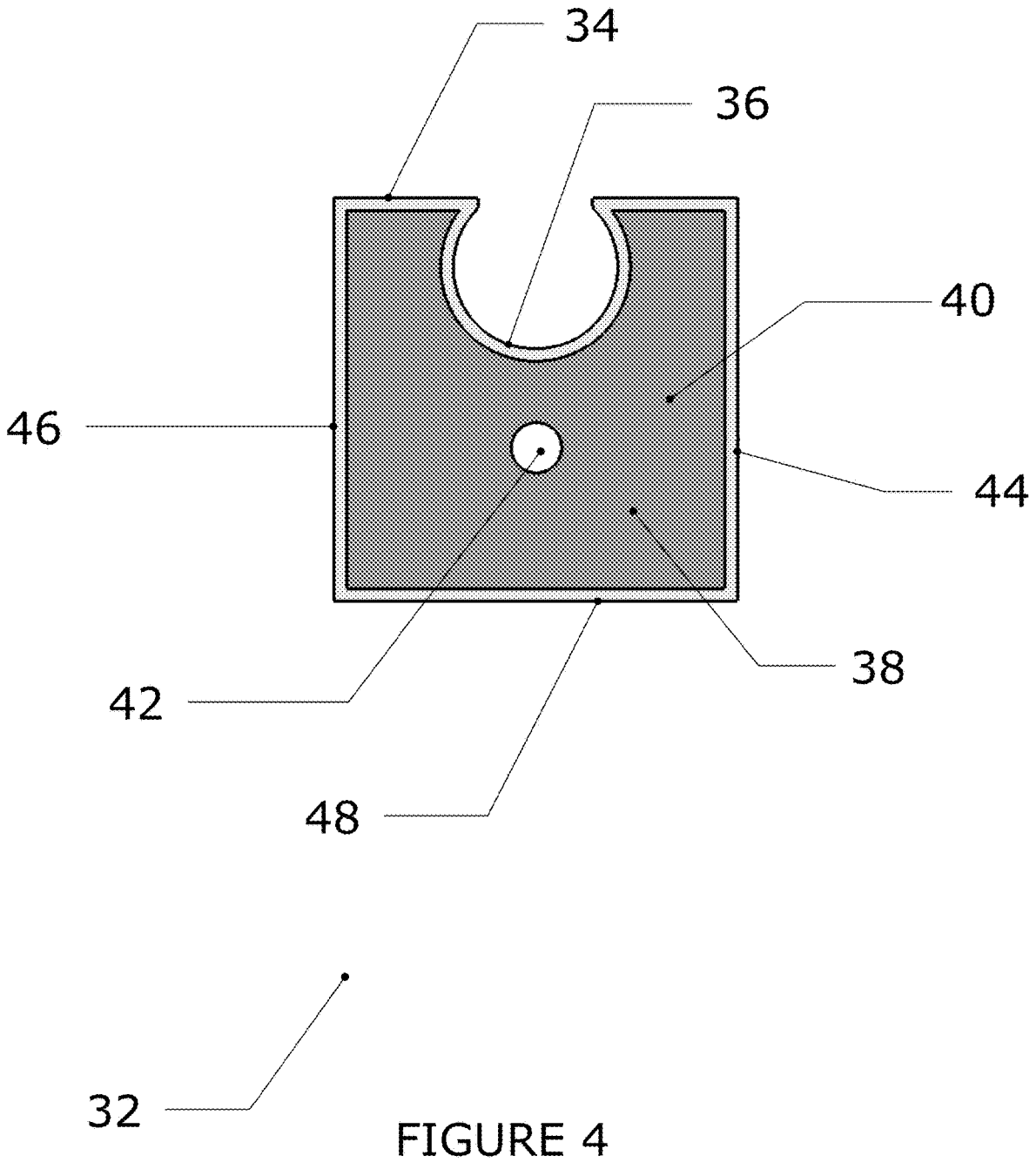
FIG. 4 is a top view of a Half End Block with Female Joint.

FIGS. 3 and 4 illustrate a Half End Block with Female Joint 32 which is the second element of the building block system invention.

FIG. 3 illustrates a perspective view of a Half End Block with Female Joint 32 and depicts a hollow cube form that has eight 90-degree vertices.

The Half End Block with Female Joint 32 may be made in any dimension suitable for the building it will be forming. In the preferred embodiment, the Half End Block with Female Joint 32 is eight inches wide, eight inches high, and eight inches long. In other embodiments, the Half End Block with Female Joint 32 has a length equal to its width and is one fourth as thick as its length.

The Half End Block with Female Joint 32 consists of an open top portion 38; a bottom portion 40 that is flat and closed with the exception of one guide conduit orifice 42 located in the center of the block 32; an unornamented front face portion 44; an unornamented rear face portion 46; a first end portion 34 that has one female mating formation 36 being a concavity; and an unornamented second end portion 48. The unornamented second end portion 48, the unornamented front face portion 44, and the unornamented rear face portion 46 are smooth flat planar surfaces.

FIG. 4 illustrates a top view of a Half End Block with Female Joint 32 and shows a female mating formation 36 that is a concavity running vertically up the first end portion 34. In the preferred embodiment, the Half End Block with Female Joint 32 has a female mating formation 36 that is a concavity with a radius of one and five-eighths inches running vertically up the first end portion 34. In other embodiments, the Half End Block with Female Joint 32 has a concavity with a radius sufficient to couple with male mating formations that are corresponding protuberances running vertically up portions of other blocks. In all embodiments of the Half End Block with Female Joint 32, the mating formations are designed so that the coupling is reversible, thereby making the block reusable.

FIG. 4 also illustrates that the Half End Block with Female Joint 32 has a bottom portion 40 that is closed with the exception of one guide conduit orifice 42 which cooperates to receive one or more threaded rods which pass vertically through the guide conduit orifice in order to align and reinforce the blocks so structural integrity is maintained when a series of blocks are stacked upwardly upon each other while building structures. In the preferred embodiment of the Half End Block with Female Joint 32, the guide conduit orifice 42 has a diameter of one and one-fourth inches. In all embodiments of the Half End Block with Female Joint 32, the diameter of the guide conduit orifice 42 is somewhat larger that the diameter of the threaded rod so that the threaded rod can be inserted through the guide conduit orifice 42 with some tolerance.

Figure 5:
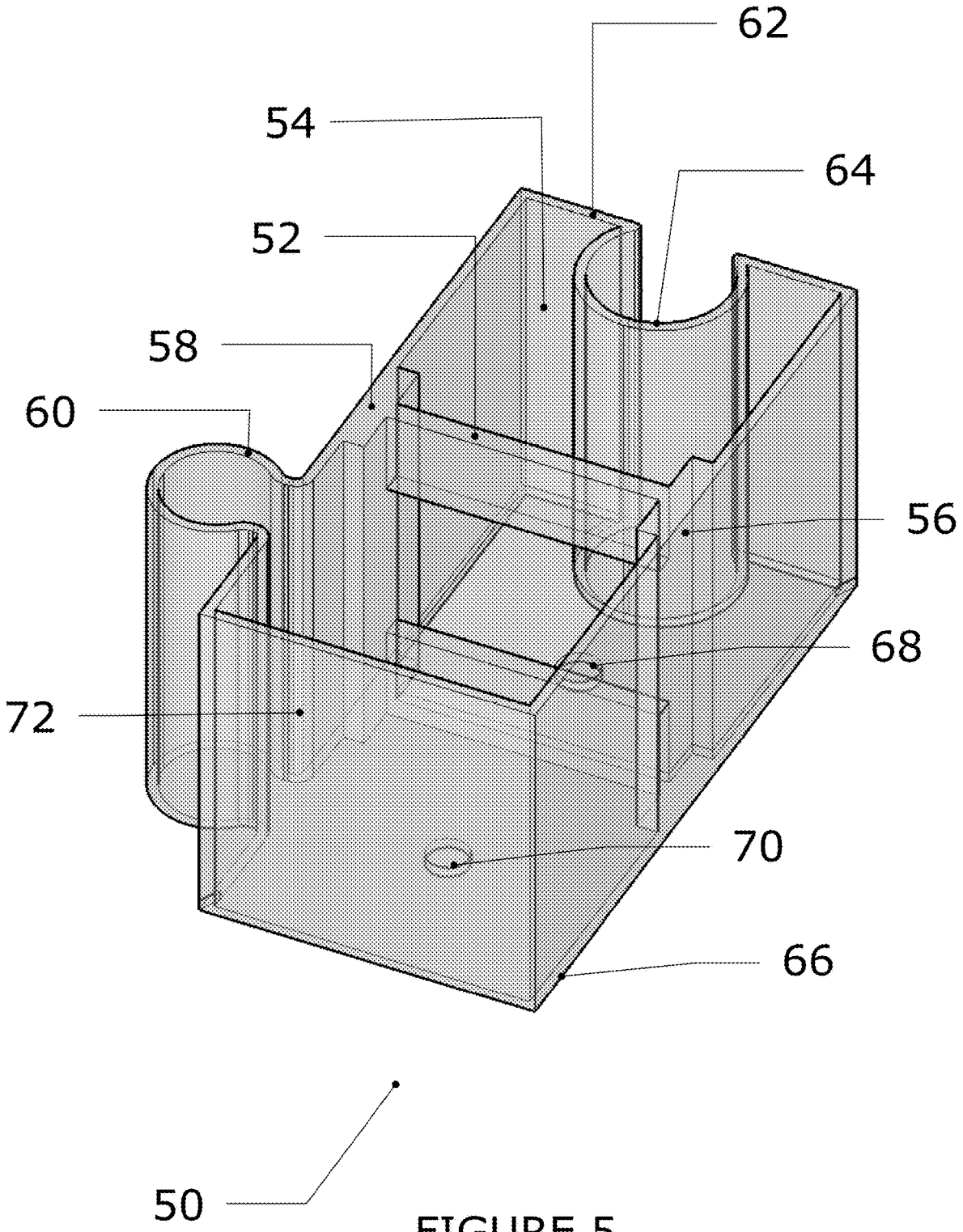
FIG. 5 is a perspective view of a Full Corner Block with Female Joint and Offset Male Corner.
Figure 6:
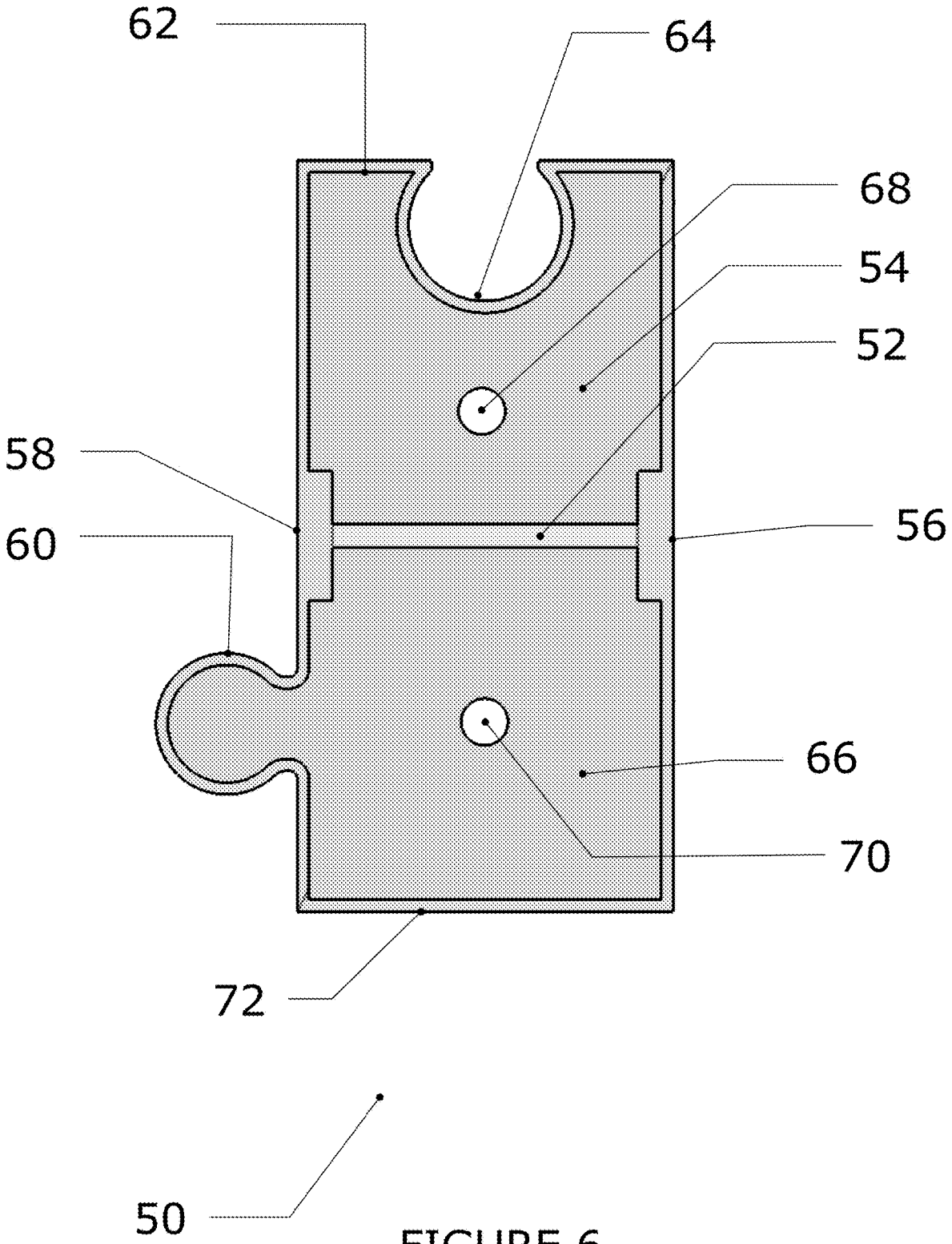
FIG. 6 is a top view of a Full Corner Block with Female Joint and Offset Male Corner.

FIGS. 5 and 6 illustrate a Full Corner Block with Female Joint and Offset Male Corner 50 which is the third element of the building block system invention.

FIG. 5 illustrates a perspective view of a Full Corner Block with Female Joint and Offset Male Corner 50 and depicts a hollow rectangular form that has eight 90-degree vertices.

The Full Corner Block with Female Joint and Offset Male Corner 50 may be made in any dimension suitable for the building it will be forming. In the preferred embodiment, the Full Corner Block with Female Joint and Offset Male Corner 50 is eight inches wide, eight inches high, and sixteen inches long. In other embodiments, the Full Corner Block with Female Joint and Offset Male Corner 50 has dimensions of two times as long as its width and is one eighth as thick as its length.

The Full Corner Block with Female Joint and Offset Male Corner 50 consists of an open top portion 54 with stiffener bars 52 bisecting the block and connecting the unornamented front face portion 56 and rear face portion 58; a bottom portion 66 that is flat and closed with the exceptions of one guide conduit orifice 68 located near the first end portion 62 and one guide conduit orifice 70 located near the unornamented second end portion 72; an unornamented front face portion 56; a rear face portion 58 that has one male mating formation 60 being a curved protuberance; a first end portion 62 that has one female mating formation 64 being a concavity; and an unornamented second end portion 72. The unornamented second end portion 72 and the unornamented front face portion 56 are smooth flat planar surfaces.

FIG. 6 illustrates a top view of a Full Corner Block with Female Joint and Offset Male Corner 50 and shows a female mating formation 64 that is a concavity running vertically up the first end portion 62, and a male mating formation 60 that is a curved protuberance running vertically up the rear face portion 58. In the preferred embodiment, the Full Corner Block with Female Joint and Offset Male Corner 50 has a female mating formation that is a concavity with a radius of one and five-eighths inches running vertically up the first end portion 62, and a male mating formation 60 that is a curved protuberance with a radius of one and one-fourth inches running vertically up the rear face portion 58. In other embodiments, the Full Corner Block with Female Joint and Offset Male Corner 50 has a concavity with a radius sufficient to couple with male mating formations that are corresponding protuberances running vertically up portions of other blocks in addition to a curved protuberance with a radius sufficient to couple with female mating formations that are corresponding concavities running vertically up portions of other blocks. In all embodiments of the Full Corner Block with Female Joint and Offset Male Corner 50, the mating formations are designed so that the coupling is reversible, thereby making the block reusable.

FIG. 6 further illustrates that the Full Corner Block with Female Joint and Offset Male Corner 50 has one stiffener bar 52 bisecting the open top portion 54 of the block and connecting the unornamented front face portion 56 and the rear face portion 58 thereby providing structural integrity to the block. In all embodiments of the Full Corner Block with Female Joint and Offset Male Corner 50, the stiffener bars are of sufficient thickness to prevent local buckling and ensure stability.

FIG. 6 also illustrates that the Full Corner Block with Female Joint and Offset Male Corner 50 has a bottom portion 66 that is closed with the exceptions of two guide conduit orifices 68 and 70, each of which cooperates to receive one or more threaded rods which pass vertically through the guide conduit orifices in order to align and reinforce the blocks so structural integrity is maintained when a series of blocks are stacked upwardly upon each other while building structures. In the preferred embodiment of the Full Corner Block with Female Joint and Offset Male Corner 50, the guide conduit orifices 68 and 70 have a diameter of one and one-fourth inches. In all embodiments of the Full Corner Block with Female Joint and Offset Male Corner 50, the diameter of the guide conduit orifices 68 and 70 are somewhat larger that the diameter of the threaded rod so that the threaded rod can be inserted through the guide conduit orifices 68 and 70 with some tolerance.

Figure 7:
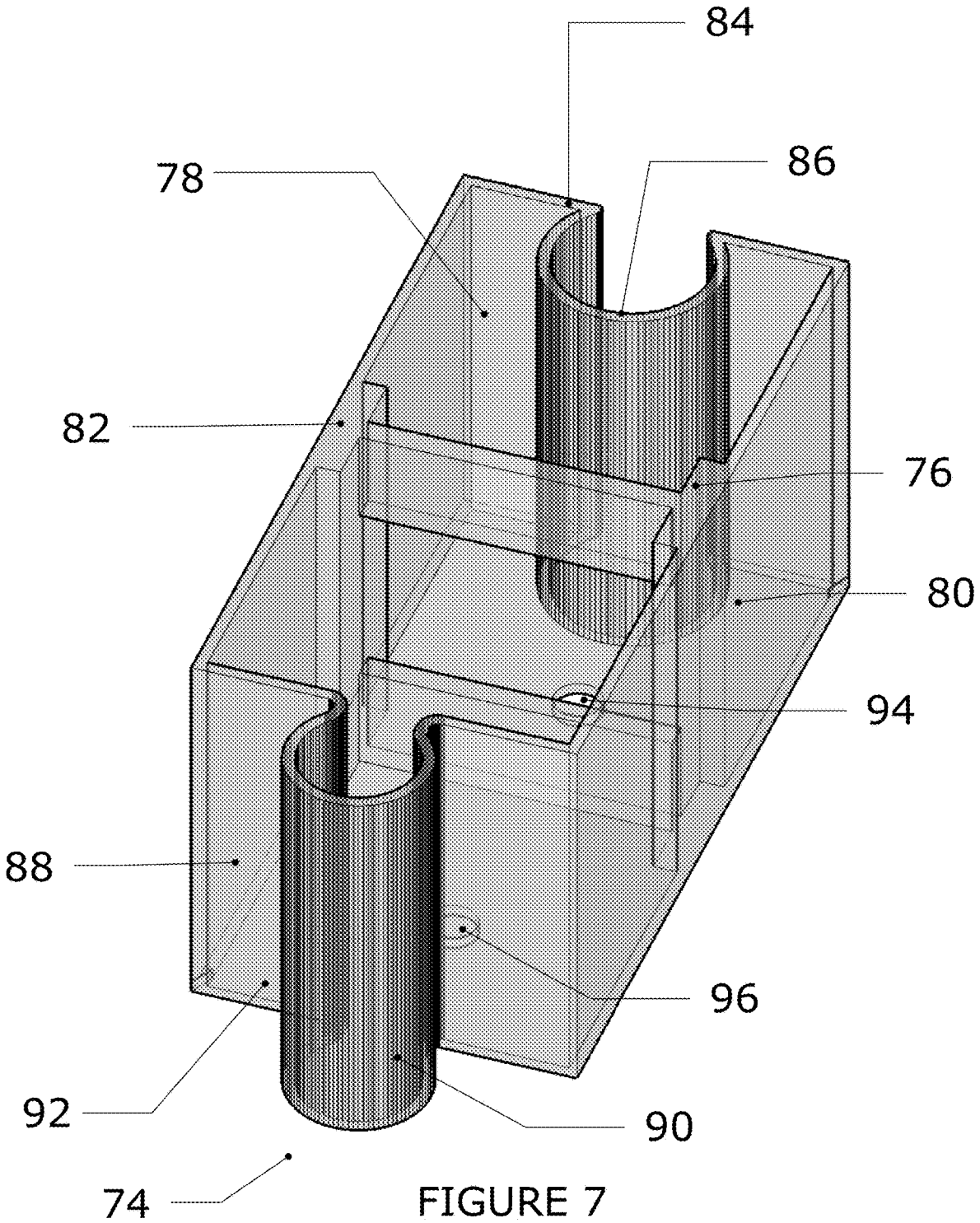
FIG. 7 is a perspective view of a Full Block with Female to Male Joint.
Figure 8:
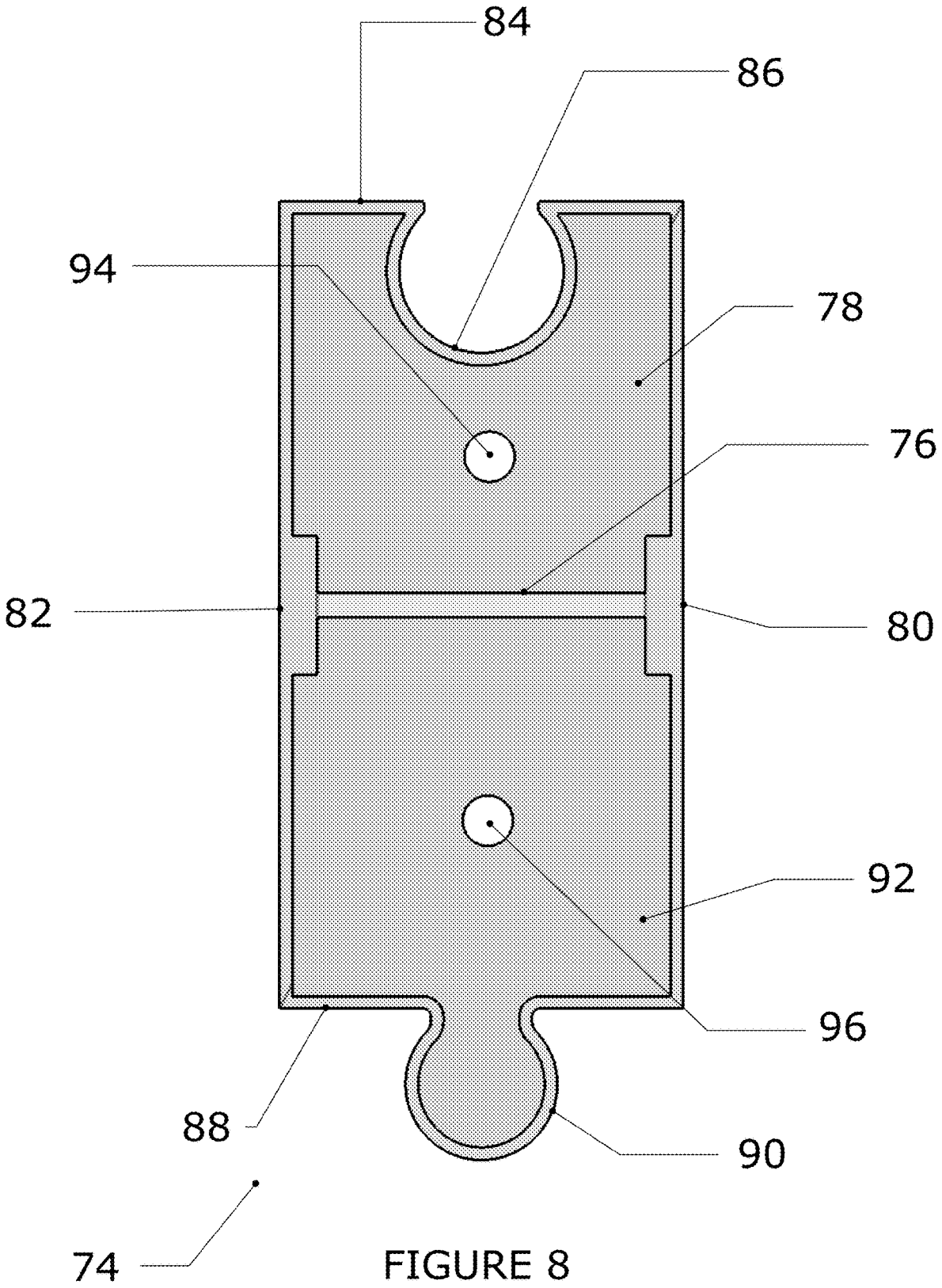
FIG. 8 is a top view of a Full Block with Female to Male Joint.

FIGS. 7 and 8 illustrate a Full Block with Female to Male Joint 74 which is the fourth element of the building block system invention.

FIG. 7 illustrates a perspective view of a Full Block with Female to Male Joint 74 and depicts a hollow rectangular form that has eight 90-degree vertices.

The Full Block with Female to Male Joint 74 may be made in any dimension suitable for the building it will be forming. In the preferred embodiment, the Full Block with Female to Male Joint 74 is eight inches wide, eight inches high, and sixteen inches long, with nineteen inches being the distance from the arc of the one male mating formation's 90 curved protuberance to the first end portion 84. In other embodiments, the Full Block with Female to Male Joint 74 has dimensions of two times as long as its width and is one eighth as thick as its length.

The Full Block with Female to Male Joint 74 consists of an open top portion 78 with stiffener bars 76 bisecting the block and connecting the unornamented front face portion 80 and the unornamented rear face portion 82; a bottom portion 92 that is flat and closed with the exceptions of one guide conduit orifice 94 located near the first end portion 84, and one guide conduit orifice 96 located near the second end portion 88; an unornamented front face portion 80; an unornamented rear face portion 82; a first end portion 84 that has one female mating formation 86 being a concavity; and a second end portion 88 that has one male mating formation 90 that is a curved protuberance. The unornamented front face portion 80 and the unornamented rear face portion 82 are smooth flat planar surfaces.

FIG. 8 illustrates a top view of a Full Block with Female to Male Joint 74 and shows a female mating formation 86 that is a concavity running vertically up the first end portion 84, and a male mating formation 90 that is a curved protuberance running vertically up the second end portion 88. In the preferred embodiment, the Full Block with Female to Male Joint 74 has a female mating formation that is a concavity with a radius of one and five-eighths inches running vertically up the first end portion 84 and a male mating formation 90 that is a curved protuberance with a radius of one and one-fourth inches running vertically up the second end portion 88. In other embodiments, the Full Block with Female to Male Joint 74 has a concavity with a radius sufficient to couple with male mating formations that are corresponding curved protuberances running vertically up portions of other blocks in addition to a curved protuberance with a radius sufficient to couple with female mating formations that are corresponding concavities running vertically up portions of other blocks. In all embodiments of the Full Block with Female to Male Joint 74, the mating formations are designed so that the coupling is reversible, thereby making the block reusable.

FIG. 8 further illustrates that the Full Block with Female to Male Joint 74 has one stiffener bar 76 bisecting the top portion 78 of the block and connecting the unornamented front face portion 80 and the unornamented rear face portion 82, thereby providing structural integrity to the block. In all embodiments of the Full Block with Female to Male Joints, the stiffener bars are of sufficient thickness to prevent local buckling and ensure stability.

FIG. 8 also illustrates that the Full Block with Female to Male Joint 74 has a bottom portion 92 that is closed with the exceptions of two guide conduit orifices 94 and 96, each of which cooperates to receive one or more threaded rods which pass vertically through the guide conduit orifices in order to align and reinforce the blocks so structural integrity is maintained when a series of blocks are stacked upwardly upon each other while building structures. In the preferred embodiment of the Full Block with Female to Male Joint 74, the guide conduit orifices 94 and 96 have a diameter of one and one-fourth inches. In all embodiments of the Full Block with Female to Male Joint 74, the diameter of the guide conduit orifices 94 and 96 are somewhat larger that the diameter of the threaded rod so that the threaded rod can be inserted through the guide conduit orifices 94 and 96 with some tolerance.

Figure 9:
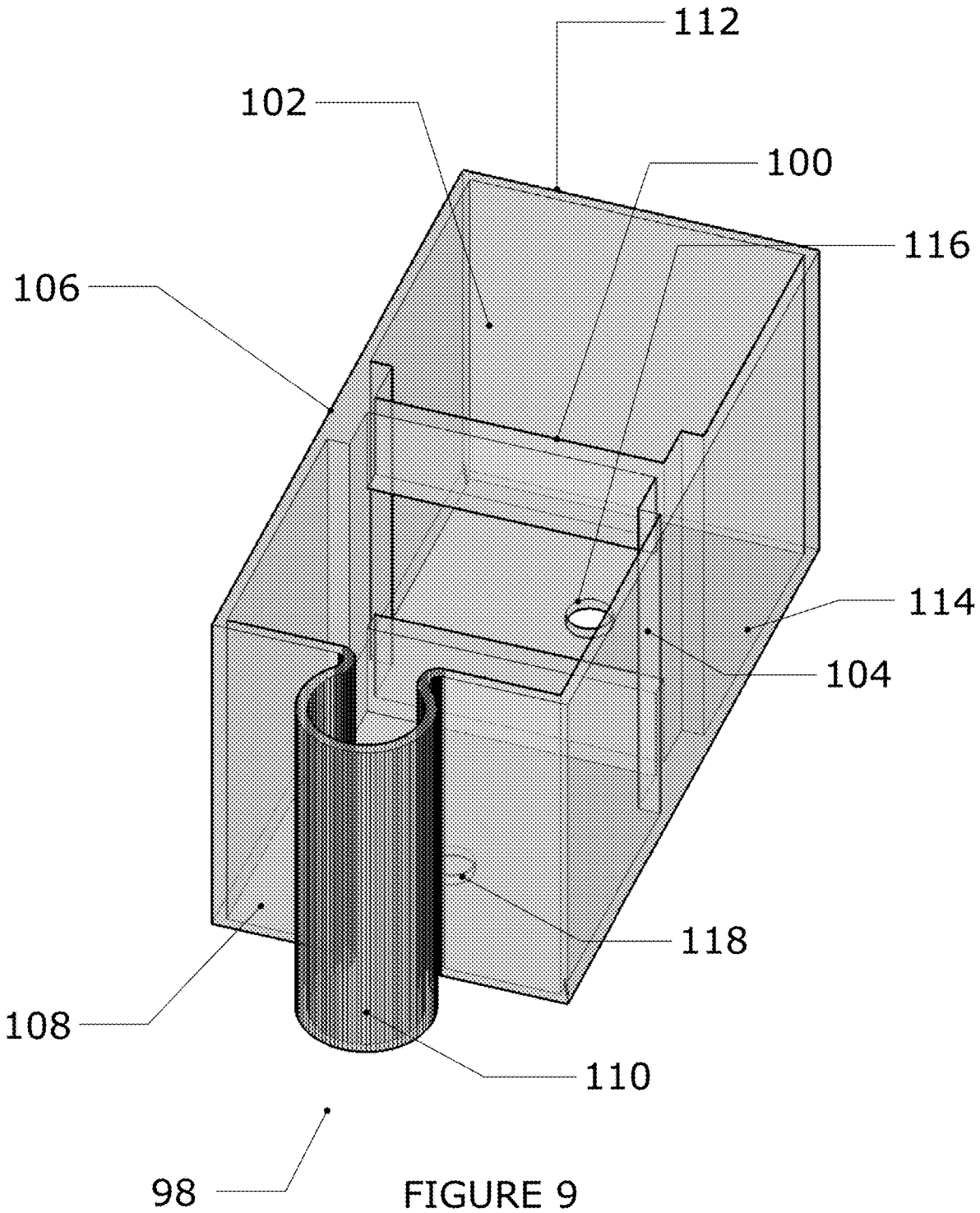
FIG. 9 is a perspective view of a Full End Block with Male Joint.
Figure 10:
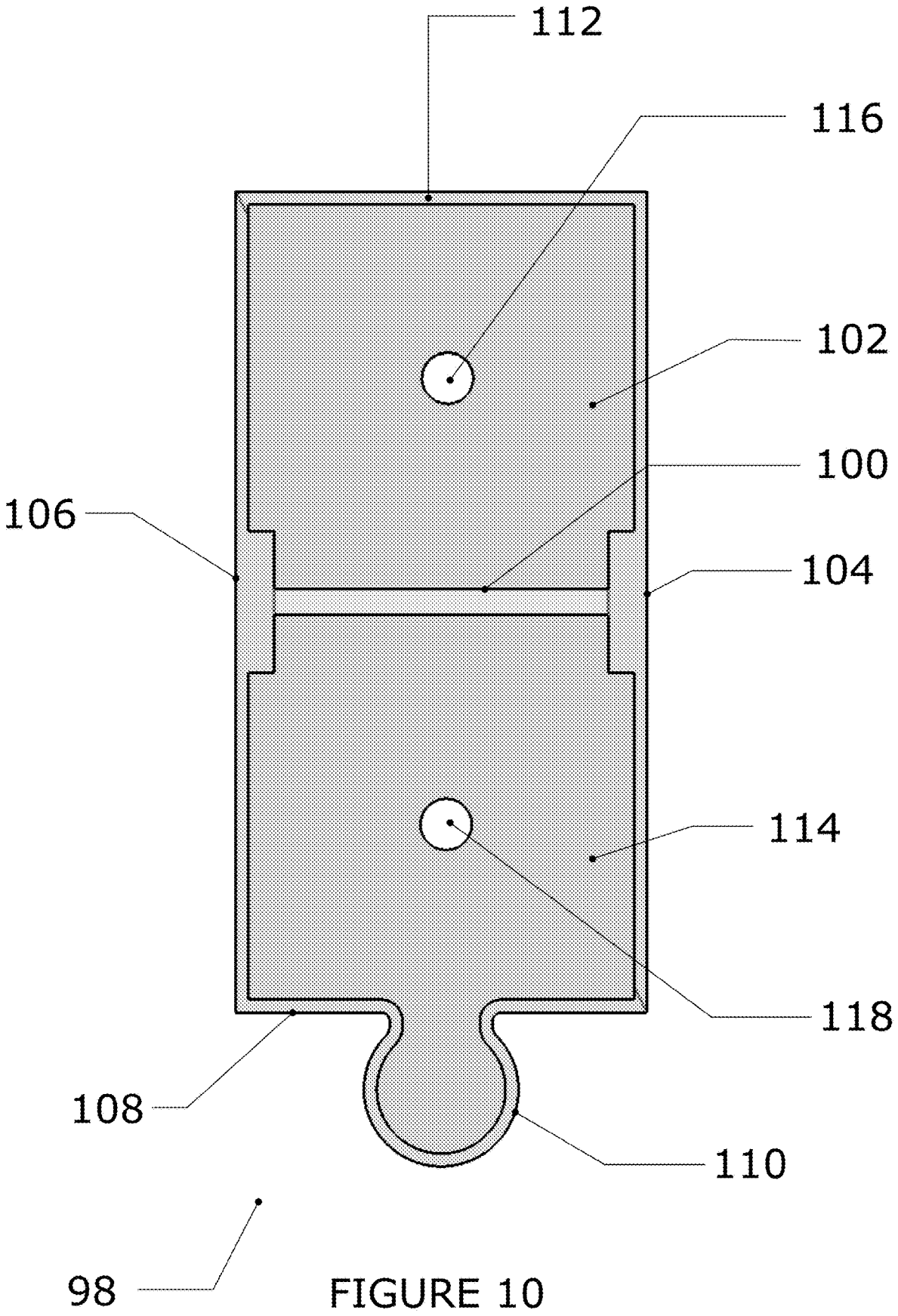
FIG. 10 is a top view of a Full End Block with Male Joint.

FIGS. 9 and 10 illustrate a Full End Block with Male Joint 98 which is the fifth element of the building block system invention.

FIG. 9 illustrates a perspective view of a Full End Block with Male Joint 98 and depicts a hollow rectangular form that has eight 90-degree vertices.

The Full End Block with Male Joint 98 may be made in any dimension suitable for the building it will be forming. In the preferred embodiment, the Full End Block with Male Joint 98 is eight inches wide, eight inches high, and sixteen inches long, with nineteen inches being the distance from the arc of the one male mating formation's 110 curved protuberance to the first end portion 112. In other embodiments, the Full End Block with Male Joint 98 has dimensions of two times as long as its width and is one eighth as thick as its length.

The Full End Block with Male Joint 98 consists of an open top portion 102 with stiffener bars 100 bisecting the block and connecting the unornamented front face portion 104 and the unornamented rear face portion 106; a bottom portion 114 that is flat and closed with the exceptions of one guide conduit orifice 116 located near the unornamented first end portion 112, and one guide conduit orifice 118 located near the second end portion 108; an unornamented front face portion 104; an unornamented rear face portion 106; an unornamented first end portion 112; and a second end portion 108 that has one male mating formation 110 that is a curved protuberance. The unornamented front face portion 104, unornamented rear face portion 106, and the unornamented first end portion 112 are smooth flat planar surfaces.

FIG. 10 illustrates a top view of a Full End Block with Male Joint 98 and shows a male mating formation 110 that is a curved protuberance running vertically up the second end portion 108. In the preferred embodiment, the Full End Block with Male Joint 98 has a male mating formation that is a curved protuberance with a radius of one and one-fourth inches running vertically up the second end portion 108. In other embodiments, the Full End Block with Male Joint 98 has a curved protuberance with a radius sufficient to couple with female mating formations that are corresponding concavities running vertically up portions of other blocks. In all embodiments of the Full End Block with Male Joint 98, the mating formations are designed so that the coupling is reversible, thereby making the block reusable.

FIG. 10 further illustrates that the Full End Block with Male Joint 98 has one stiffener bar 100 bisecting the open top portion 102 and connecting the unornamented front face portion 104 and the unornamented rear face portion 106, thereby providing structural integrity to the block. In all embodiments of the Full End Block with Male Joint 98, the stiffener bars are of sufficient thickness to prevent local buckling and ensure stability.

FIG. 10 also illustrates that the Full End Block with Male Joint 98 has a bottom portion 114 that is closed with the exceptions of two guide conduit orifices 116 and 118, each of which cooperates to receive one or more threaded rods which pass vertically through the guide conduit orifices in order to align and reinforce the blocks so structural integrity is maintained when a series of blocks are stacked upwardly upon each other while building structures. In the preferred embodiment of the Full End Block with Male Joint 98, the guide conduit orifices 116 and 118 have a diameter of one and one-fourth inches. In all embodiments of the Full End Block with Male Joint 98, the diameter of the guide conduit orifices 116 and 118 are somewhat larger that the diameter of the threaded rod so that the threaded rod can be inserted through the guide conduit orifices 116 and 118 with some tolerance.

Figure 11:
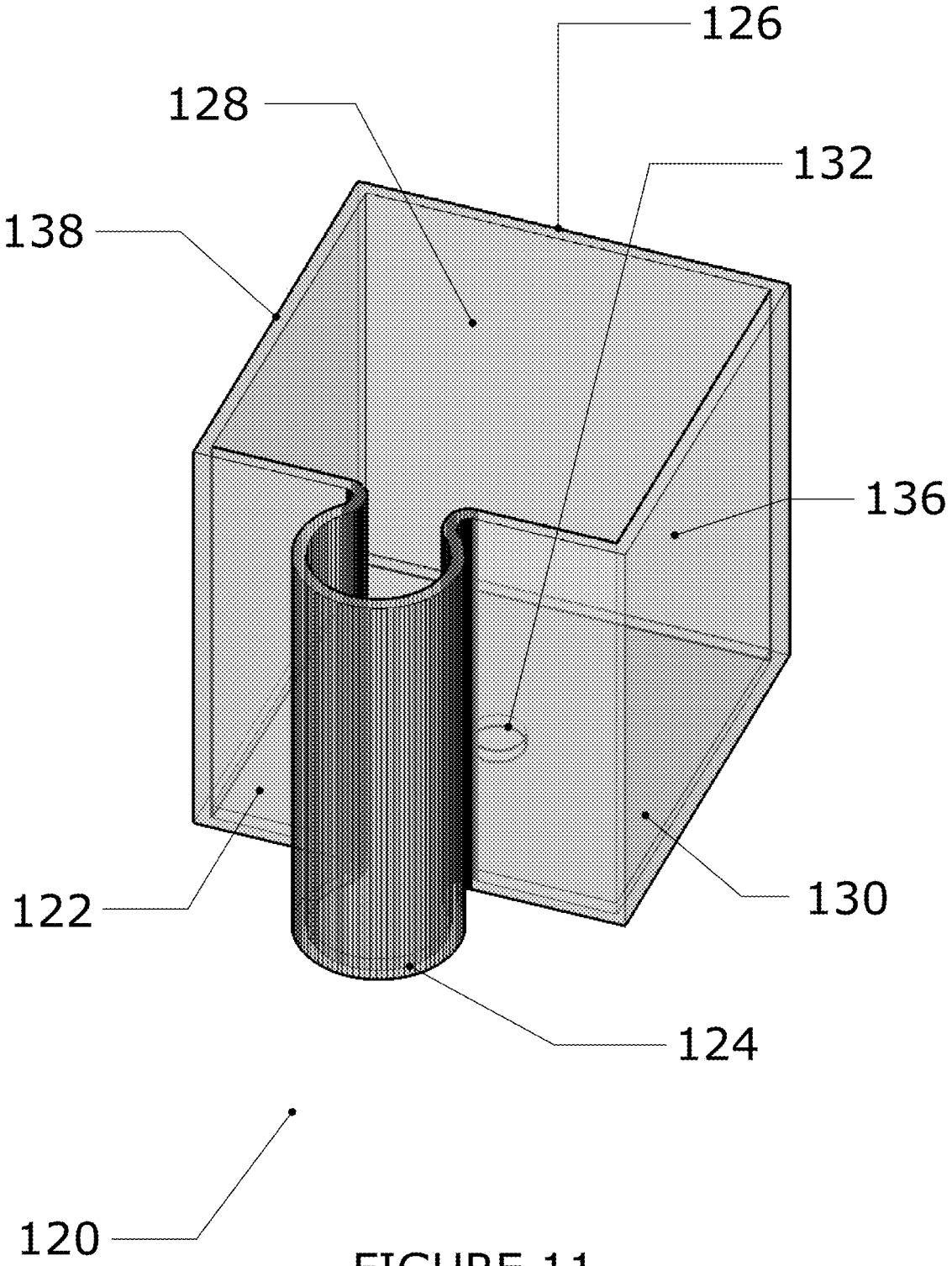
FIG. 11 is a perspective view of a Half End Block with Male Joint.
Figure 12:
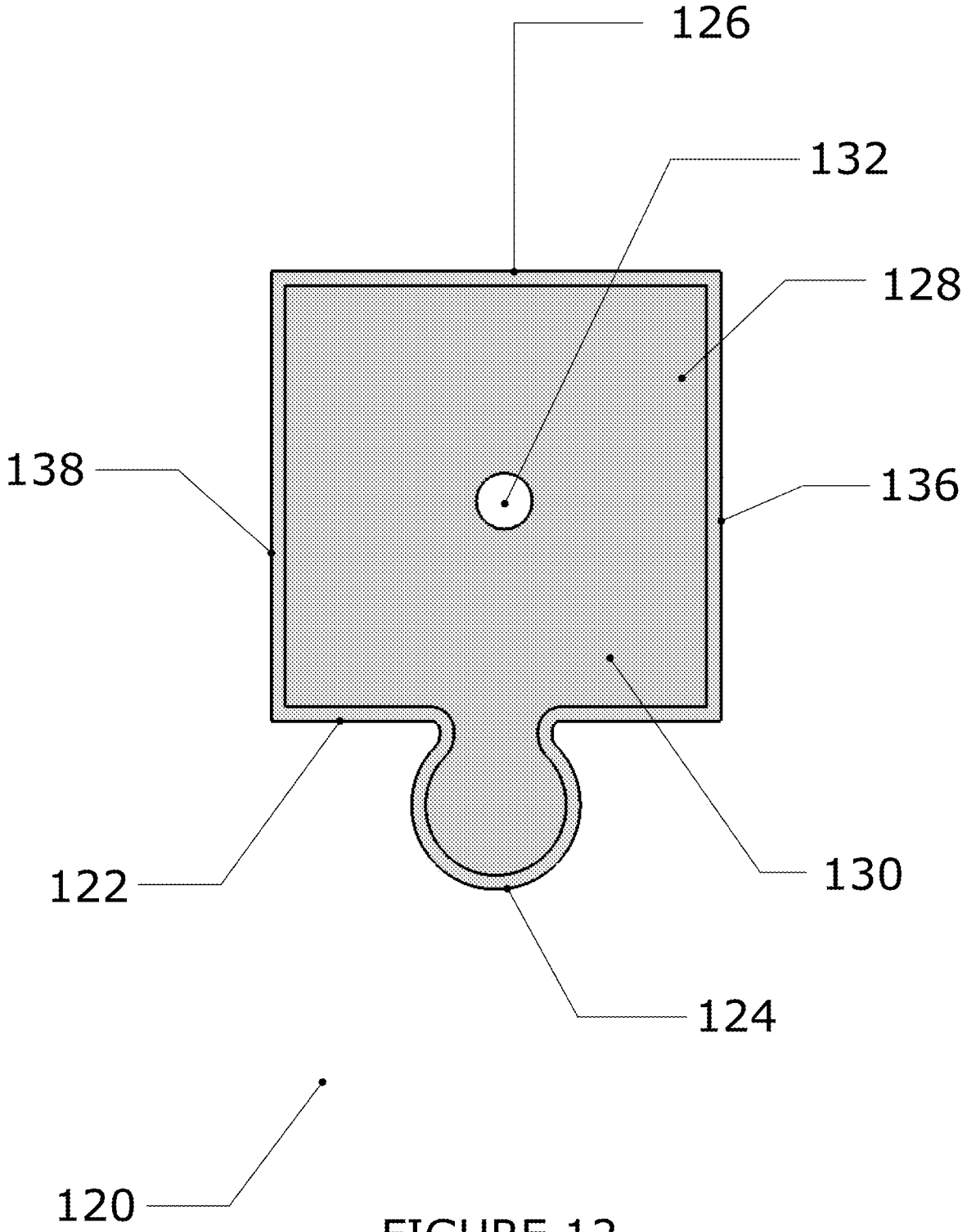
FIG. 12 is a top view of a Half End Block with Male Joint.

FIGS. 11 and 12 illustrate a Half End Block with Male Joint 120 which is the sixth element of the building block system invention.

FIG. 11 illustrates a perspective view of a Half End Block with Male Joint 120 and depicts a hollow cube form that has eight 90-degree vertices.

The Half End Block with Male Joint 120 may be made in any dimension suitable for the building it will be forming. In the preferred embodiment, the Half End Block with Male Joint 120 is eight inches wide, eight inches high, and eight inches long, with eleven inches being the distance from the arc of the one male mating formation's 124 curved protuberance to the unornamented first end portion 126. In other embodiments, the Half End Block with Male Joint 120 has a length equal to its width and is one fourth as thick as its length.

The Half End Block with Male Joint 120 consists of an open top portion 128; a bottom portion 130 that is flat and closed with the exception of one guide conduit orifice 132 located in the center of the block; an unornamented front face portion 136; an unornamented rear face portion 138; an unornamented first end portion 126; and a second end portion 122 that has one male mating formation 124 being a curved protuberance. The unornamented front face portion 136, the unornamented rear face portion 138, and the unornamented first end portion 126 are smooth flat planar surfaces.

FIG. 12 illustrates a top view of a Half End Block with Male Joint 120 and shows a male mating formation 124 that is a curved protuberance running vertically up the second end portion 122. In the preferred embodiment, the Half End Block with Male Joint 120 has a male mating formation that is a curved protuberance with a radius of one and one-fourth inches running vertically up the first end portion 122. In other embodiments, the Half End Block with Male Joint 120 has a curved protuberance with a radius sufficient to couple with female mating formations that are corresponding concavities running vertically up portions of other blocks. In all embodiments of the Half End Block with Male Joint 120, the mating formations are designed so that the coupling is reversible, thereby making the block reusable.

FIG. 12 also illustrates that the Half End Block with Male Joint 120 has a bottom portion 130 that is closed with the exception of one guide conduit orifice 132 which cooperates to receive one or more threaded rods which pass vertically through the guide conduit orifice in order to align and reinforce the blocks so structural integrity is maintained when a series of blocks are stacked upwardly upon each other while building structures. In the preferred embodiment of the Half End Block with Male Joint 120, the guide conduit orifice 132 has a diameter of one and one-fourth inches. In all embodiments of the Half End Block with Male Joint 120, the diameter of the guide conduit orifice 132 is somewhat larger that the diameter of the threaded rod so that the threaded rod can be inserted through the guide conduit orifice 132 with some tolerance.

Figure 13:
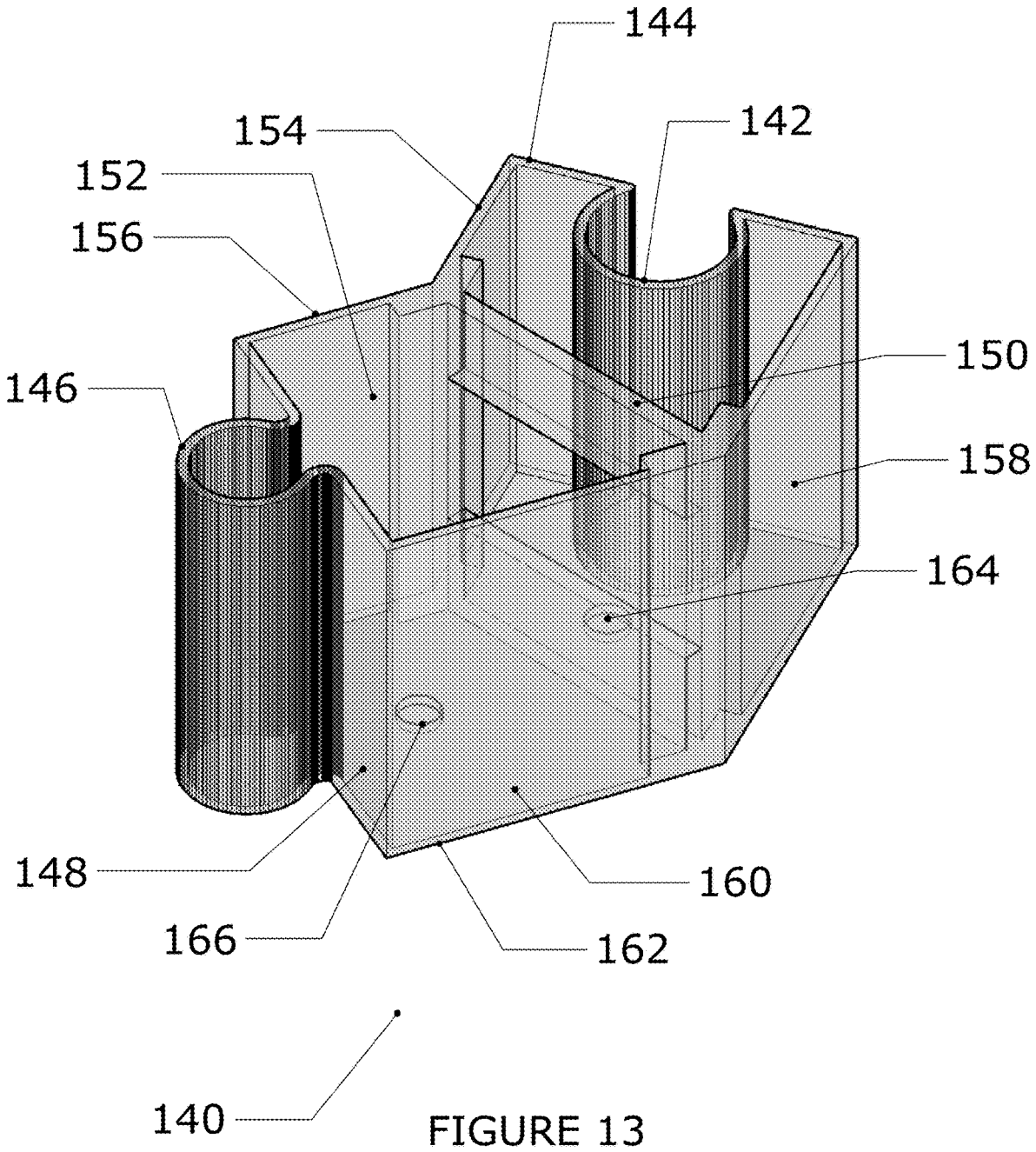
FIG. 13 is a perspective view of a 45-degree Angle Half Block with Female to Male Joint.
Figure 14:
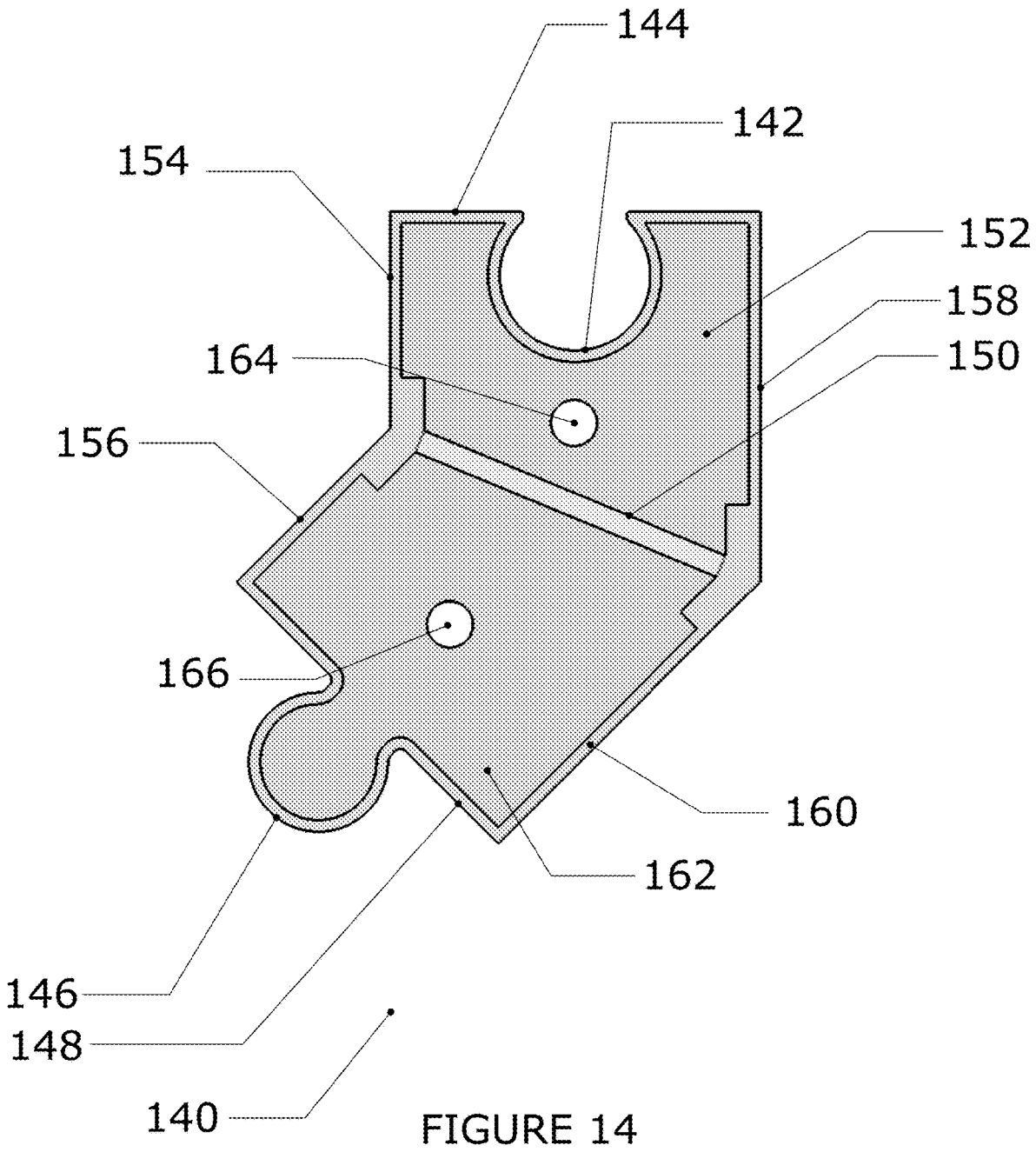
FIG. 14 is a top view of a 45-degree Angle Half Block with Female to Male Joint.

FIGS. 13 and 14 illustrate a 45-degree Angle Half Block with a Female to Male Joint 140 which is the seventh element of the building block system invention.

FIG. 13 illustrates a perspective view of a 45-degree Angle Half Block with a Female to Male Joint 140 and depicts a hollow octahedron-shaped form that has four 45-degree vertices and eight 90-degree vertices.

The 45-degree Angle Half Block with a Female to Male Joint 140 may be made in any dimension suitable for the building it will be forming. In the preferred embodiment, the 45-degree Angle Half Block with a Female to Male Joint 140 is eight inches wide, eight inches high, and eight inches long, with seven and eleven-sixteenths inches being the distance as measured from the arc of the male mating formation's 146 curved protuberance to the 45-degree vertex formed by the intersection of the upper right front face portion 158 and the lower right front face portion 160. In other embodiments, the 45-degree Angle Half Block with a Female to Male Joint 140 has dimensions of two times as long as its width and one eighth as thick as its length.

The 45-degree Angle Half Block with a Female to Male Joint 140 consists of an open a top portion 152 with stiffener bars 150 bisecting the block and connecting one vertex formed by the intersection of the unornamented upper left rear face portion 154 and the unornamented lower left rear face portion 156, and a second vertex formed by the intersection of the unornamented upper right front face portion 158 and the unornamented lower right front face portion 160; a bottom portion 162 that is flat and closed with the exceptions of one guide conduit orifice 164 located near the first end portion 144, and one guide conduit orifice 166 located near the second end portion 148; an unornamented upper left rear face portion 154; an unornamented lower left rear face portion 156 that intersects at a 45-degree angle with the unornamented upper left rear face portion 154 to form a vertex; an unornamented upper right front face portion 158; an unornamented lower right front face portion 160 that intersects at a 45-degree angle with the unornamented upper right front face portion 158 to form a vertex; a first end portion 144 that has one female mating formation 142 being a concavity; and a second end portion 148 that has one male mating formation 146 that is a curved protuberance. The unornamented upper left rear face portion 154, the unornamented lower left rear face portion 156, the unornamented upper right front face portion 158, and the unornamented lower right front face portion 160 are smooth flat planar surfaces.

FIG. 14 illustrates a top view of a 45-degree Angle Half Block with a Female to Male Joint 140 and shows a female mating formation 142 that is a concavity running vertically up the first end portion 144, and a male mating formation 146 that is a curved protuberance running vertically up the second end portion 148. In the preferred embodiment, the 45-degree Angle Half Block with a Female to Male Joint 140 has a female mating formation that is a concavity with a radius of one and five-eighths inches running vertically up the first end portion 144, and a male mating formation 146 that is a curved protuberance with a radius of one and one-fourth inches running vertically up the second end portion 148. In other embodiments, the 45-degree Angle Half Block with a Female to Male Joint 140 has a concavity and a curved protuberance both of which have a radius sufficient to couple with corresponding mating formations running vertically up portions of other blocks. In all embodiments of the 45-degree Angle Half Block with a Female to Male Joint 140, the mating formations 142 and 146 are designed so that the coupling is reversible, thereby making the block reusable.

FIG. 14 further illustrates that the 45-degree Angle Half Block with a Female to Male Joint 140 has one stiffener bar 150 bisecting the open top portion 152 and connecting the one vertex formed by the intersection of the unornamented upper left rear face portion 154 and the unornamented lower left rear face portion 156, and a second vertex formed by the intersection of the unornamented upper right front face portion 158 and the unornamented lower right front face portion 160, thereby providing structural integrity to the block. In all embodiments of the 45-degree Angle Half Block with a Female to Male Joint 140, the stiffener bars are of sufficient thickness to prevent local buckling and ensure stability.

FIG. 14 also illustrates that the 45-degree Angle Half Block with a Female to Male Joint 140 has a bottom portion 162 that is closed with the exceptions of two guide conduit orifices 164 and 166, each of which cooperates to receive one or more threaded rods which pass vertically through the guide conduit orifices in order to align and reinforce the blocks so structural integrity is maintained when a series of blocks are stacked upwardly upon each other while building structures. In the preferred embodiment of the 45-degree Angle Half Block with a Female to Male Joint 140, the guide conduit orifices 164 and 166 have a diameter of one and one-fourth inches. In all embodiments of the 45-degree Angle Half Block with a Female to Male Joint 140, the diameter of the guide conduit orifices 164 and 166 are somewhat larger that the diameter of the threaded rod so that the threaded rod can be inserted through the guide conduit orifices 164 and 166 with some tolerance.

Figure 15:
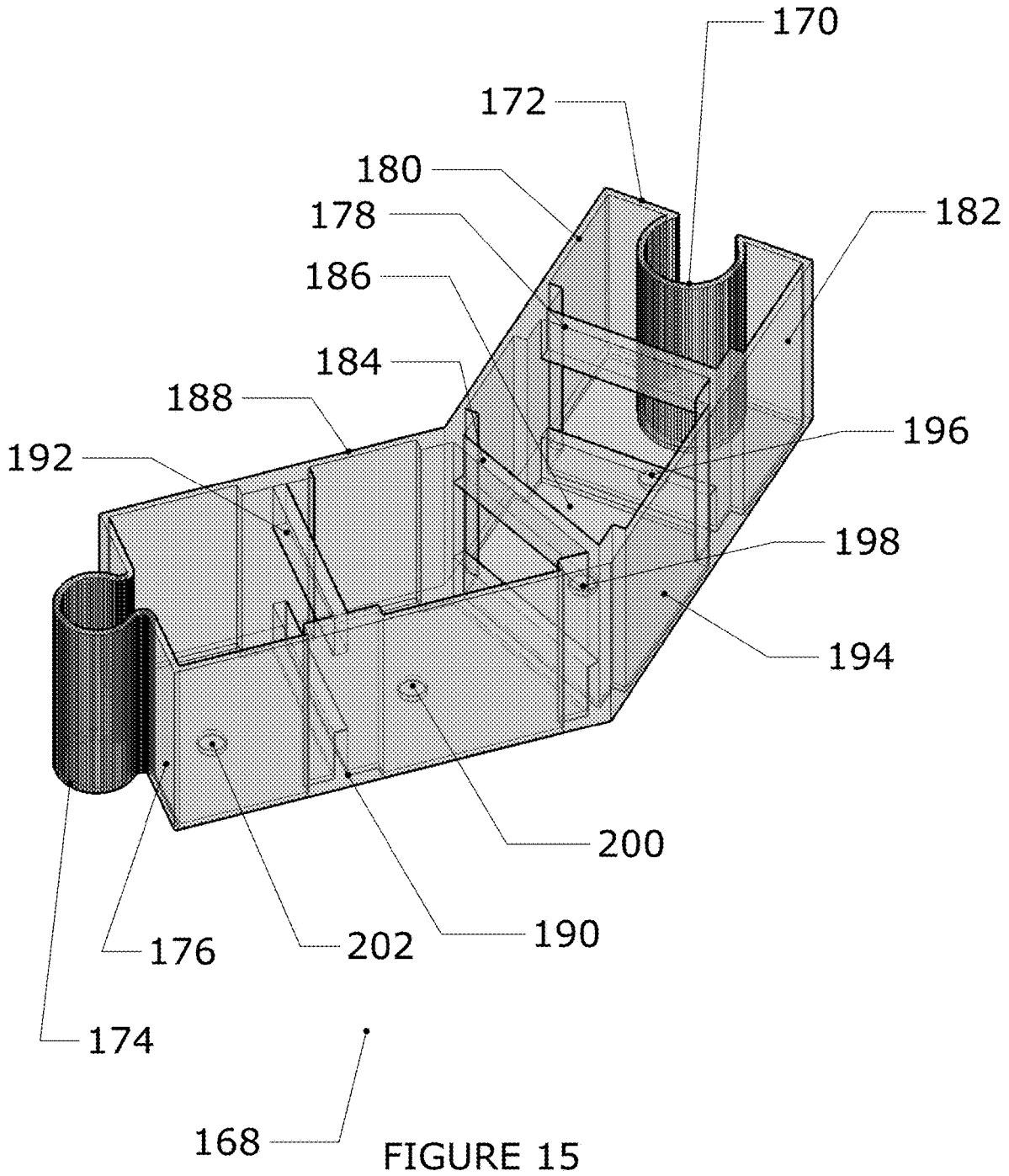
FIG. 15 is a perspective view of a 45-degree Angle Full Block with Female to Male Joint.
Figure 16:
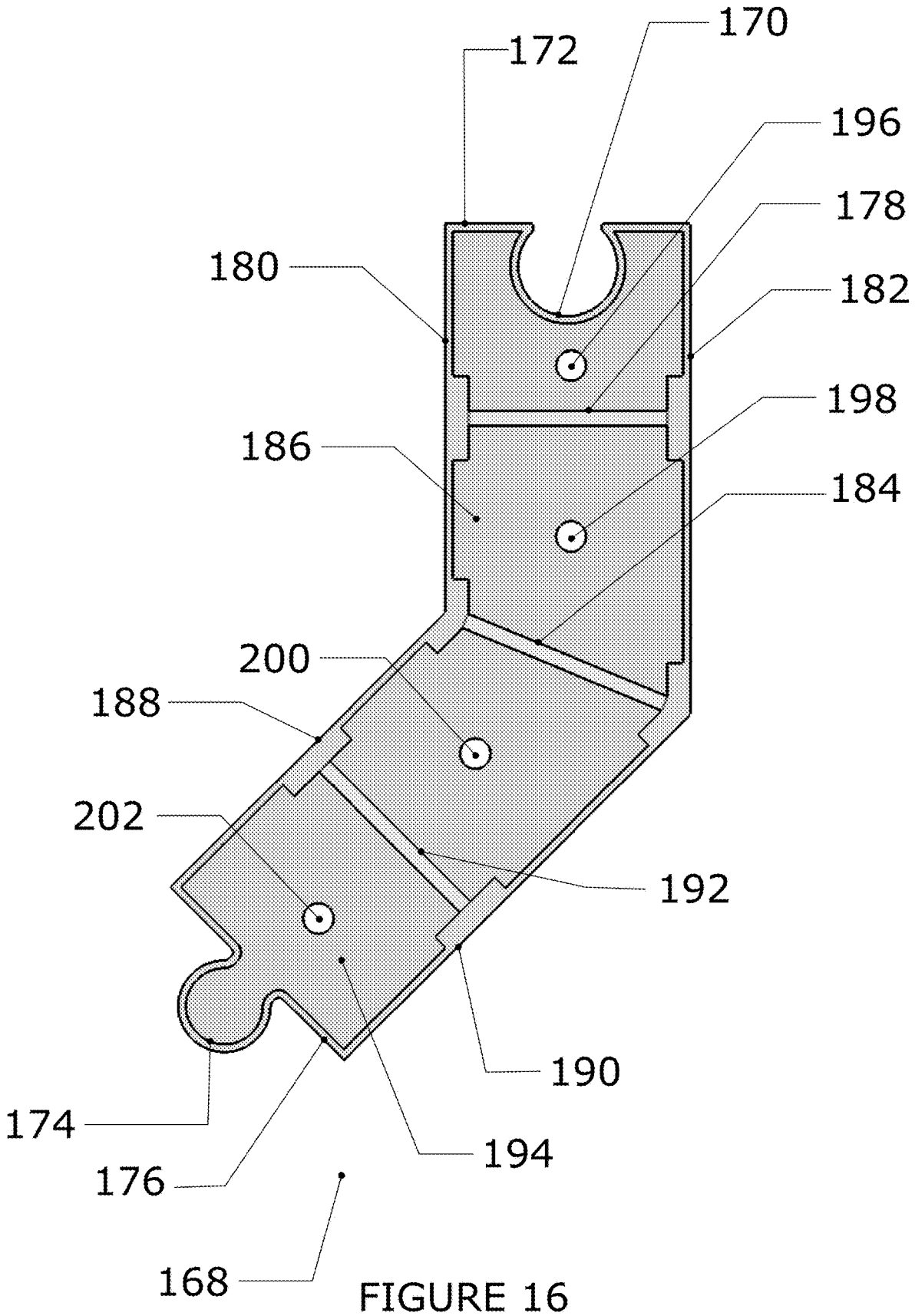
FIG. 16 is a top view of a 45-degree Angle Full Block with Female to Male Joint.

FIGS. 15 and 16 illustrate a 45-degree Angle Full Block with a Female to Male Joint 168 which is the eighth element of the building block system invention.

FIG. 15 illustrates a perspective view of a 45-degree Angle Full Block with a Female to Male Joint 168 and depicts a hollow octahedron-shaped form that has four 45-degree vertices and eight 90-degree vertices.

The 45-degree Angle Full Block with a Female to Male Joint 168 may be made in any dimension suitable for the building it will be forming. In the preferred embodiment, the 45-degree Angle Full Block with a Female to Male Joint 168 is eight inches wide, eight inches high, and sixteen inches long, with fifteen and eleven-sixteenths inches being the distance from the arc of the male mating formation's 174 curved protuberance to the 45-degree vertex formed by the intersection of the upper right front face portion 182 and the lower right front face portion 190.

The 45-degree Angle Full Block with a Female to Male Joint 168 consists of an open top portion 186 with stiffener bars 178, 184, and 192 that quarter the block; a bottom portion 194 that is flat and closed with the exceptions of one guide conduit orifice 196 located near the arc of the female mating formation 170, one guide conduit orifice 198 located near the upper stiffener bar 178, one guide conduit orifice 200 located near the lower stiffener bar 192, and one guide conduit orifice 202 located near the second end portion 176; an unornamented upper left rear face portion 180; an unornamented lower left rear face portion 188 that intersects at a 45-degree angle with the unornamented upper left rear face portion 180 to form a vertex; an unornamented upper right front face portion 182; an unornamented lower right front face portion 190 that intersects at a 45-degree angle with the upper right front face portion 182 to form a vertex; a first end portion 172 that has one female mating formation 170 being a concavity; and a second end portion 176 that has one male mating formation 174 that is a curved protuberance. The unornamented upper left rear face portion 180, the unornamented lower left rear face portion 188, the unornamented upper right front face portion 182, the unornamented lower right front face portion 190 are smooth flat planar surfaces.

FIG. 16 illustrates a top view of a 45-degree Angle Full Block with a Female to Male Joint 168 and shows a female mating formation 170 that is a concavity running vertically up the first end portion 172, and a male mating formation 174 that is a curved protuberance running vertically up the second end portion 176. In the preferred embodiment, the 45-degree Angle Full Block with a Female to Male Joint 168 has a female mating formation 170 that is a concavity with a radius of one and five-eighths inches running vertically up the first end portion 172, and a male mating formation 174 that is a curved protuberance with a radius of one and one-fourth inches running vertically up the second end portion 176. In other embodiments, the 45-degree Angle Full Block with a Female to Male Joint 168 has a concavity and a curved protuberance both of which have a radius sufficient to couple with corresponding mating formations running vertically up portions of other blocks. In all embodiments of the 45-degree Angle Full Block with a Female to Male Joint 168, the mating formations 170 and 174 are designed so that the coupling is reversible, thereby making the block reusable.

FIG. 16 further illustrates that the 45-degree Angle Full Block with a Female to Male Joint 168 has three stiffener bars 178, 184, 192 bisecting the open top portion 186 and providing structural integrity to the block. The upper stiffener bar 178 runs parallel to the first end portion 172 and is perpendicular to the unornamented upper left rear face portion 180 and the unornamented upper right front face portion 182. The center stiffener bar 184 runs across the open top portion 186 and connects one vertex formed by the intersection of the unornamented upper left rear face portion 180 and the unornamented lower left rear face portion 188 and a second vertex formed by the intersection of the unornamented upper right front face portion 182 and the unornamented lower right front face portion 190. The lower stiffener bar 192 runs parallel to the second end portion 176 and is perpendicular to the unornamented lower left rear face portion 188 and the unornamented lower right front face portion 190. In all embodiments of the 45-degree Angle Full Block with a Female to Male Joint 168, the stiffener bars are of sufficient thickness to prevent local buckling and ensure stability.

FIG. 16 also illustrates that the 45-degree Angle Full Block with a Female to Male Joint 168 has a bottom portion 194 that is closed with the exceptions of four guide conduit orifices 196, 198, 200, and 202, each of which cooperates to receive one or more threaded rods which pass vertically through the guide conduit orifices in order to align and reinforce the blocks so structural integrity is maintained when a series of blocks are stacked upwardly upon each other while building structures. In the preferred embodiment of the 45-degree Angle Full Block with a Female to Male Joint 168, the guide conduit orifices 196, 198, 200, and 202 have a diameter of one and one-fourth inches. In all embodiments of the 45-degree Angle Full Block with a Female to Male Joint 168, the diameter of the guide conduit orifices 196, 198, 200, and 202 are somewhat larger that the diameter of the threaded rod so that the threaded rod can be inserted through the guide conduit orifices 196, 198, 200, and 202 with some tolerance.

Figure 17:
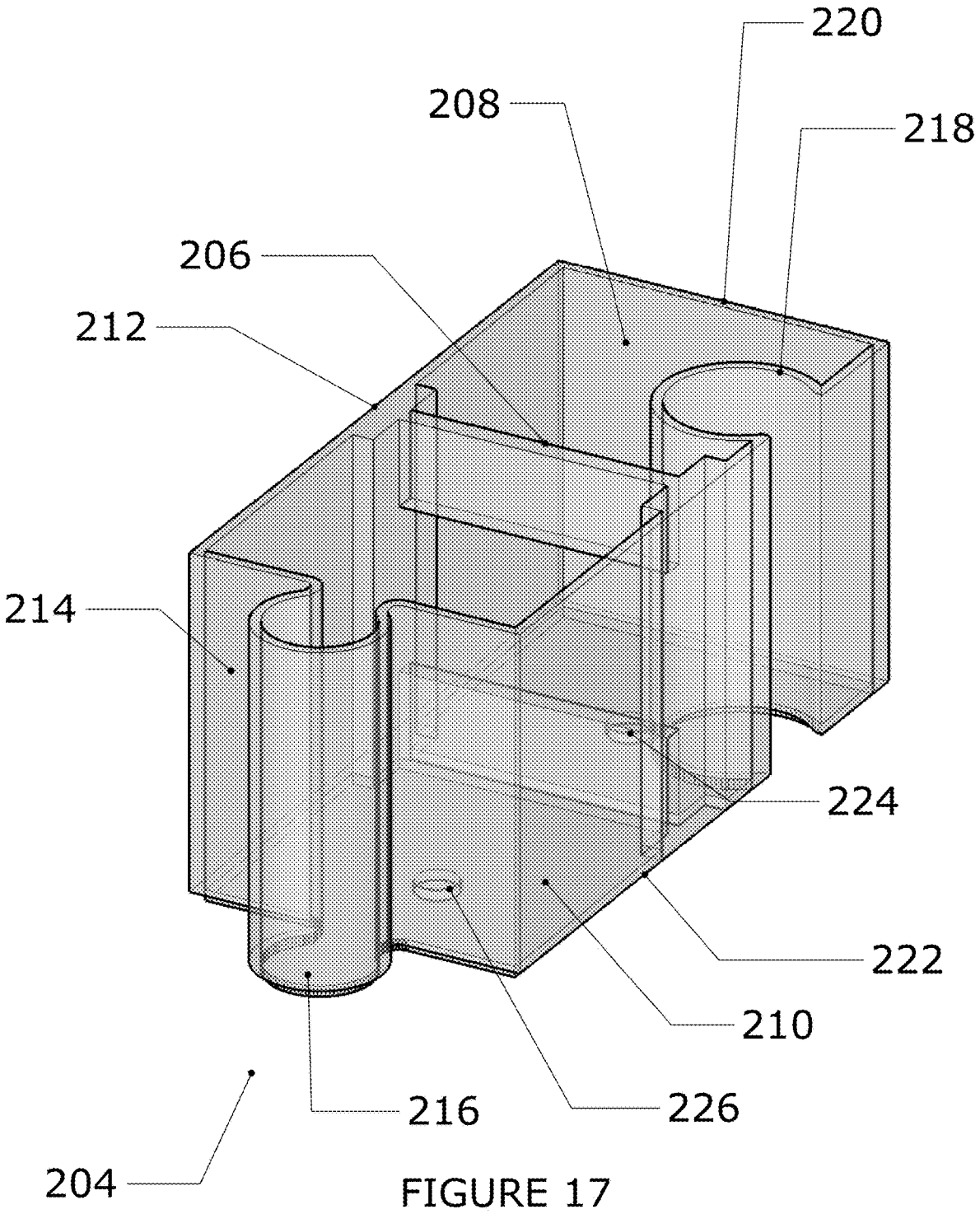
FIG. 17 is a perspective view of a Full Corner Block with Male Joint and Offset Female Corner.
Figure 18:
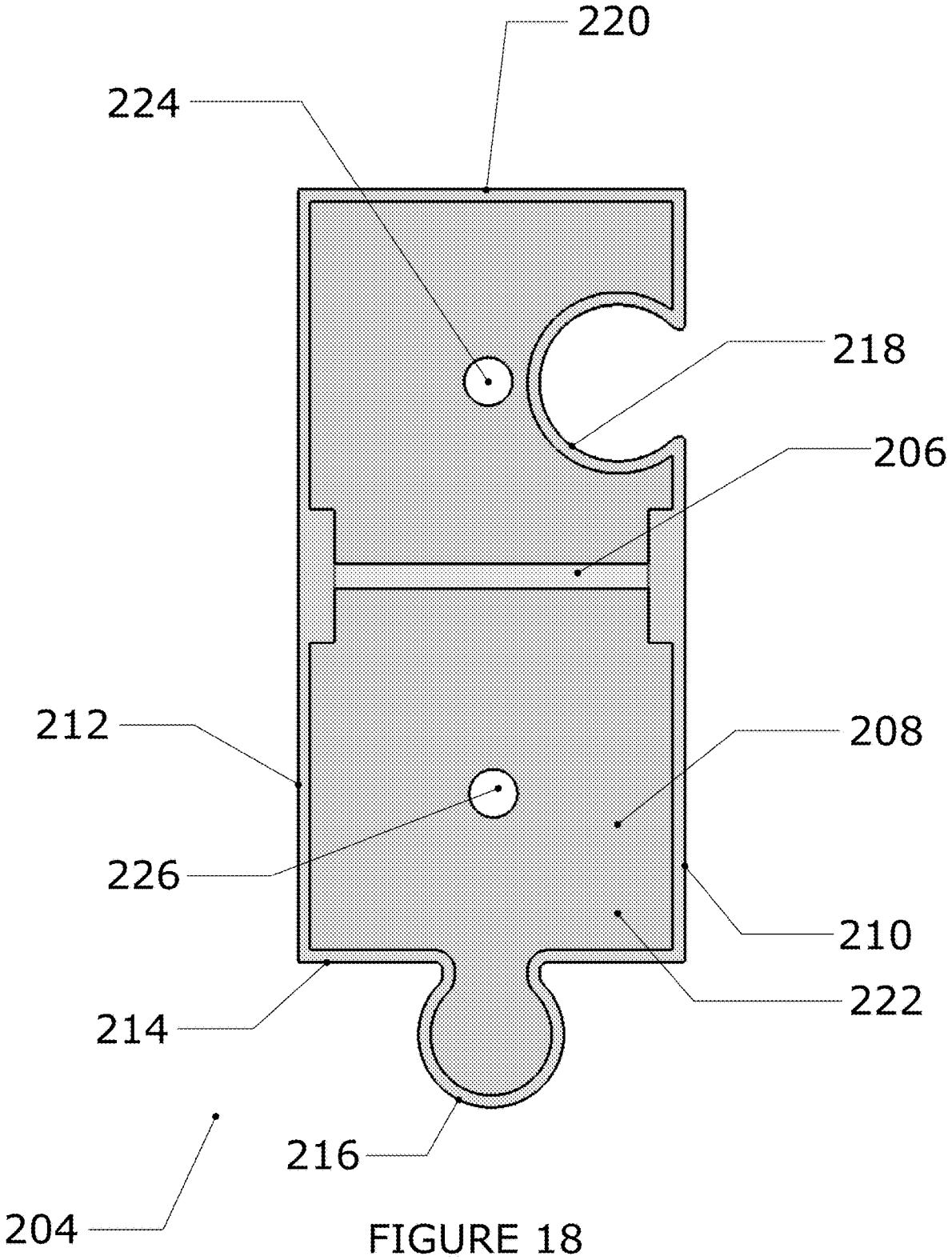
FIG. 18 is a top view of a Full Corner Block with Male Joint and Offset Female Corner.

FIGS. 17 and 18 illustrate a Full Corner Block with Male Joint and Offset Female Corner 204 which is the ninth element of the building block system invention.

FIG. 17 illustrates a perspective view of a Full Corner Block with Full Corner Block with Male Joint and Offset Female Corner 204 and depicts a hollow rectangular form that has eight 90-degree vertices.

The Full Corner Block with Male Joint and Offset Female Corner 204 may be made in any dimension suitable for the building it will be forming. In the preferred embodiment, the Full Corner Block with Male Joint and Offset Female Corner 204 is eight inches wide, eight inches high, and sixteen inches long, with nineteen inches being the distance from the arc of the one male mating formation's 216 curved protuberance to the unornamented first end portion 220. In other embodiments, the Full Corner Block with Male Joint and Offset Female Corner 204 has dimensions of two times as long as its width and is one eighth as thick as its length.

The Full Corner Block with Male Joint and Offset Female Corner 204 consists of an open top portion 208 with one stiffener bar 206 bisecting the block and connecting the front face portion 210 and the unornamented rear face portion 212; a bottom portion 222 that is flat and closed with the exceptions of one guide conduit orifice 224 located near the unornamented first end portion 220, and one guide conduit orifice 226 located near the second end portion 214; a front face portion 210 that has one female mating formation 218 being a concavity located near the first end portion 220; an unornamented rear face portion 212; an unornamented first end portion 220; and a second end portion 214 that has one male mating formation 216 being a curved protuberance. The unornamented rear face portion 212 and the unornamented first end portion 220 are smooth flat planar surfaces.

FIG. 18 illustrates a top view of a Full Corner Block with Male Joint and Offset Female Corner 204 and shows a male mating formation 216 that is a curved protuberance running vertically up the second end portion 214, and a female mating formation 218 that is a concavity running vertically up the front face portion 210. In the preferred embodiment, the Full Corner Block with Male Joint and Offset Female Corner 204 has a female mating formation 218 that is a concavity with a radius of one and five-eighths inches running vertically up the front face portion 210, and a male mating formation 216 that is a curved protuberance with a radius of one and one-fourth inches running vertically up the second end portion 214. In other embodiments, the Full Corner Block with Male Joint and Offset Female Corner 204 has a concavity with a radius sufficient to couple with male mating formations that are corresponding protuberances running vertically up portions of other blocks in addition to a curved protuberance with a radius sufficient to couple with female mating formations that are corresponding concavities running vertically up portions of other blocks. In all embodiments of the Full Corner Block with Male Joint and Offset Female Corner 204 the mating formations are designed so that the coupling is reversible, thereby making the block reusable.

FIG. 18 further illustrates that the Full Corner Block with Male Joint and Offset Female Corner 204 has one stiffener bar 206 bisecting the open top portion 208 of the block and connecting the unornamented rear face portion 212 and the front face portion 210, thereby providing structural integrity to the block. In all embodiments of the Full Corner Block with Male Joint and Offset Female Corner 204, the stiffener bars are of sufficient thickness to prevent local buckling and ensure stability.

FIG. 18 also illustrates that the Full Corner Block with Male Joint and Offset Female Corner 204 has a bottom portion 222 that is closed with the exceptions of two guide conduit orifices 224 and 226, each of which cooperates to receive one or more threaded rods which pass vertically through the guide conduit orifices in order to align and reinforce the blocks so structural integrity is maintained when a series of blocks are stacked upwardly upon each other while building structures. In the preferred embodiment of the Full Corner Block with Male Joint and Offset Female Corner 204, the guide conduit orifices 224 and 226 have a diameter of one and one-fourth inches. In all embodiments of the Full Corner Block with Male Joint and Offset Female Corner 204, the diameter of the guide conduit orifices 224 and 226 are somewhat larger that the diameter of the threaded rod so that the threaded rod can be inserted through the guide conduit orifices 224 and 226 with some tolerance.

Figure 19:
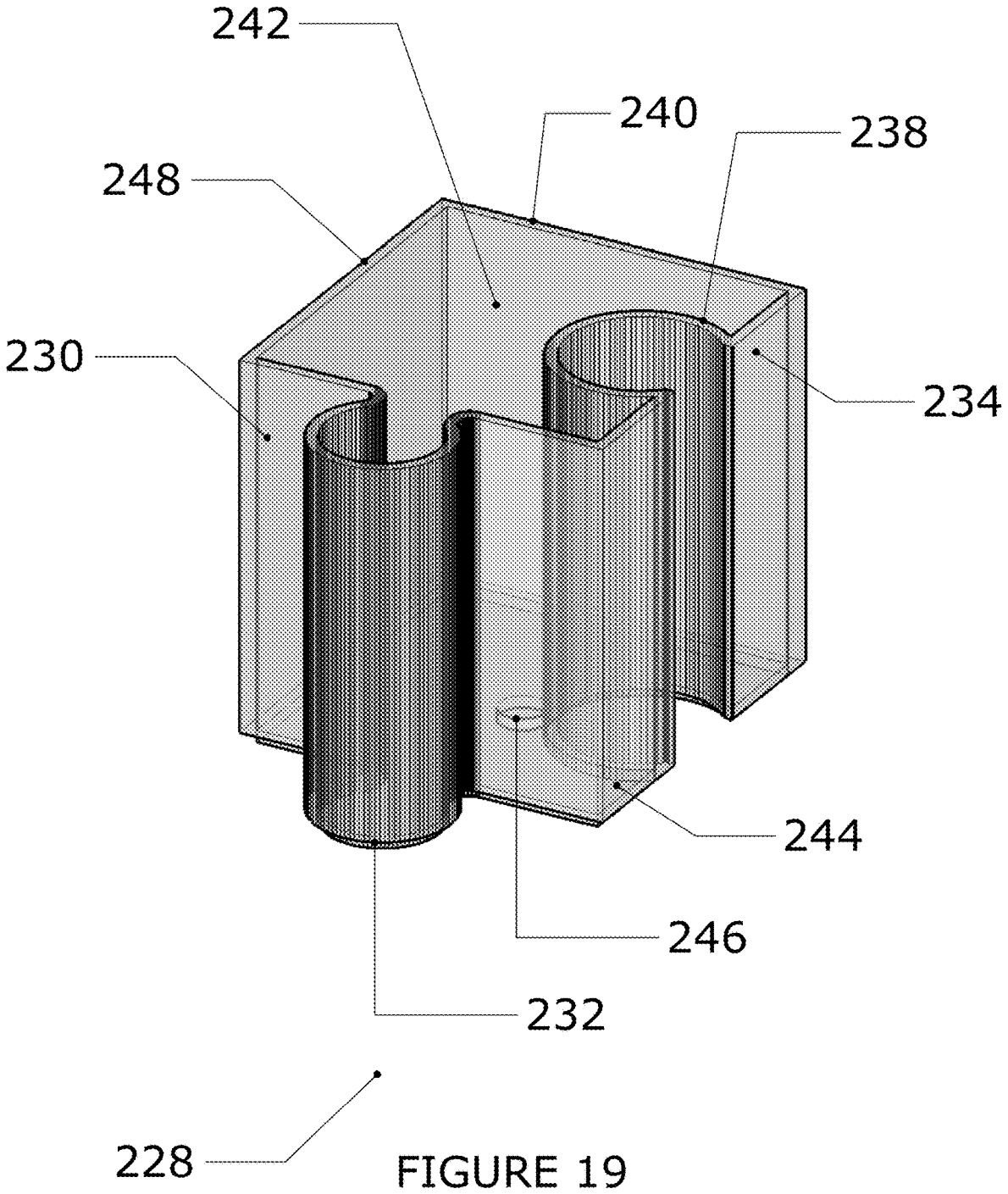
FIG. 19 is a perspective view of a Half Corner Block with Male Joint and Offset Female Corner.
Figure 20:
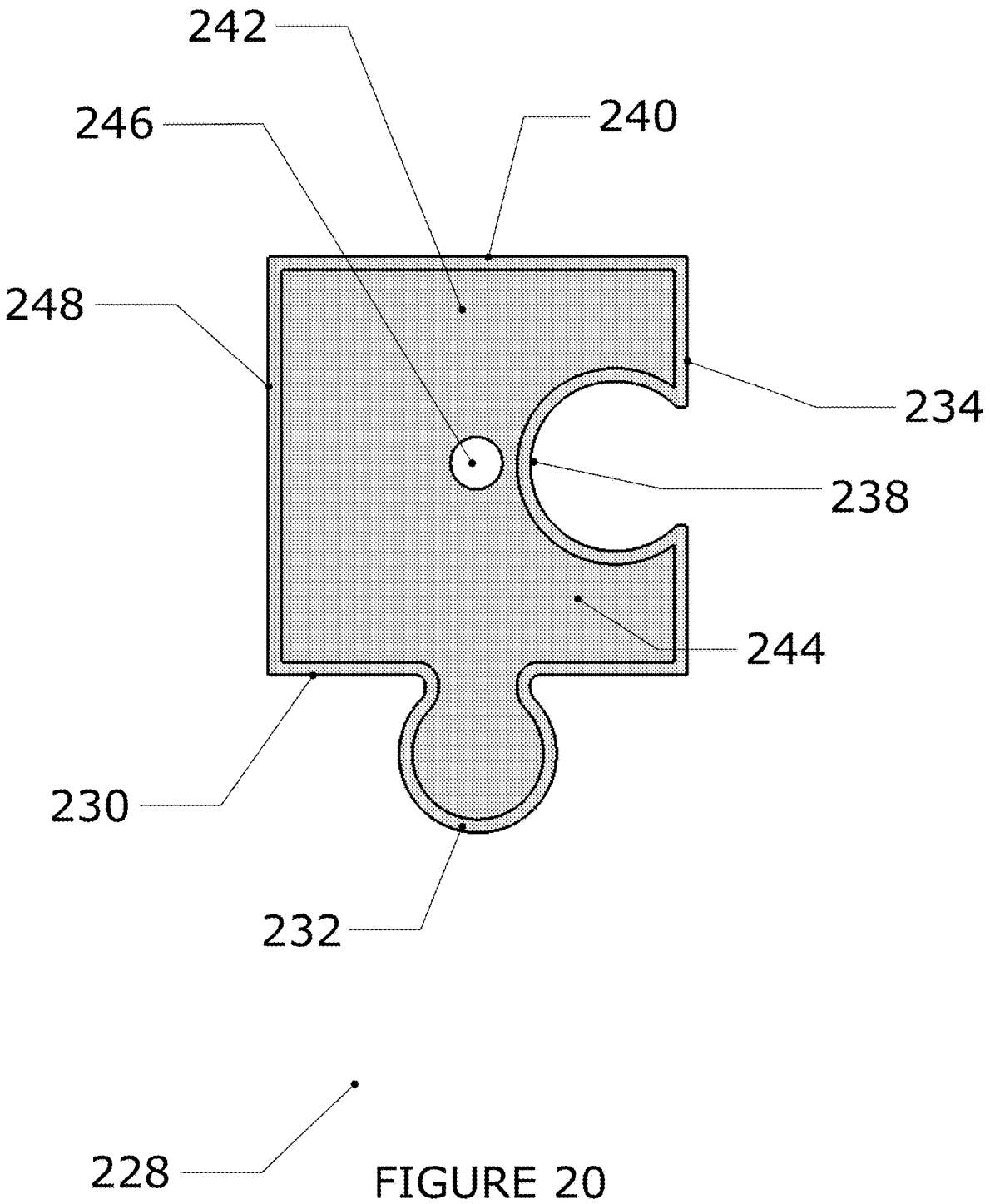
FIG. 20 is a top view of a Half Corner Block with Male Joint and Offset Female Corner.

FIGS. 19 and 20 illustrate a Half Corner Block with Male Joint and Offset Female Corner 228 which is the tenth element of the building block system invention.

FIG. 19 illustrates a perspective view of a Half Corner Block with Male Joint and Offset Female Corner 228 and depicts a hollow cube form that has eight 90-degree vertices. The Half Corner Block with Male Joint and Offset Female Corner 228 may be made in any dimension suitable for the building it will be forming. In the preferred embodiment, the Half Corner Block with Male Joint and Offset Female Corner 228 is eight inches wide, eight inches high, and eight inches long, with eleven inches being the distance from the arc of the one male mating formation's 232 curved protuberance to the unornamented first end portion 240. In other embodiments, the Half Corner Block with Male Joint and Offset Female Corner 228 has a length equal to its width and is one fourth as thick as its length.

The Half Corner Block with Male Joint and Offset Female Corner 228 consists of an open top portion 242; a bottom portion 244 that is flat and closed with the exception of one guide conduit orifice 246 located in the center of the block; a front face portion 234 that has one female mating formation 238 being a concavity; an unornamented rear face portion 248; an unornamented first end portion 240; and a second end portion 230 that has one male mating formation 232 being a curved protuberance. The unornamented rear face portion 248 and the unornamented first end portion 240 are smooth flat planar surfaces.

FIG. 20 illustrates a top view of a Half Corner Block with Male Joint and Offset Female Corner 228 and shows a male mating formation 232 that is a curved protuberance running vertically up the second end portion 230, and a female mating formation 238 that is a concavity running vertically up the front face portion 234. In the preferred embodiment, the Half Corner Block with Male Joint and Offset Female Corner 228 has a female mating formation 238 that is a concavity with a radius of one and five-eighths inches running vertically up the front face portion 234, and a male mating formation 232 that is a curved protuberance with a radius of one and one-fourth inches running vertically up the second end portion 230. In other embodiments, the Half Corner Block with Male Joint and Offset Female Corner 228 has a concavity with a radius sufficient to couple with male mating formations that are corresponding protuberances running vertically up portions of other blocks in addition to a curved protuberance with a radius sufficient to couple with female mating formations that are corresponding concavities running vertically up portions of other blocks. In all embodiments of the Half Corner Block with Male Joint and Offset Female Corner 228 the mating formations are designed so that the coupling is reversible, thereby making the block reusable.

FIG. 20 also illustrates that the Half Corner Block with Male Joint and Offset Female Corner 228 has a bottom portion 244 that is closed with the exception of one guide conduit orifice 246 which cooperates to receive one or more threaded rods which pass vertically through the guide conduit orifice in order to align and reinforce the blocks so structural integrity is maintained when a series of blocks are stacked upwardly upon each other while building structures. In the preferred embodiment of the Half Corner Block with Male Joint and Offset Female Corner 228, the guide conduit orifice 246 has a diameter of one and one-fourth inches. In all embodiments of the Half Corner Block with Male Joint and Offset Female Corner 228, the diameter of the guide conduit orifice 246 is somewhat larger that the diameter of the threaded rod so that the threaded rod can be inserted through the guide conduit orifice 246 with some tolerance.

Figure 21:
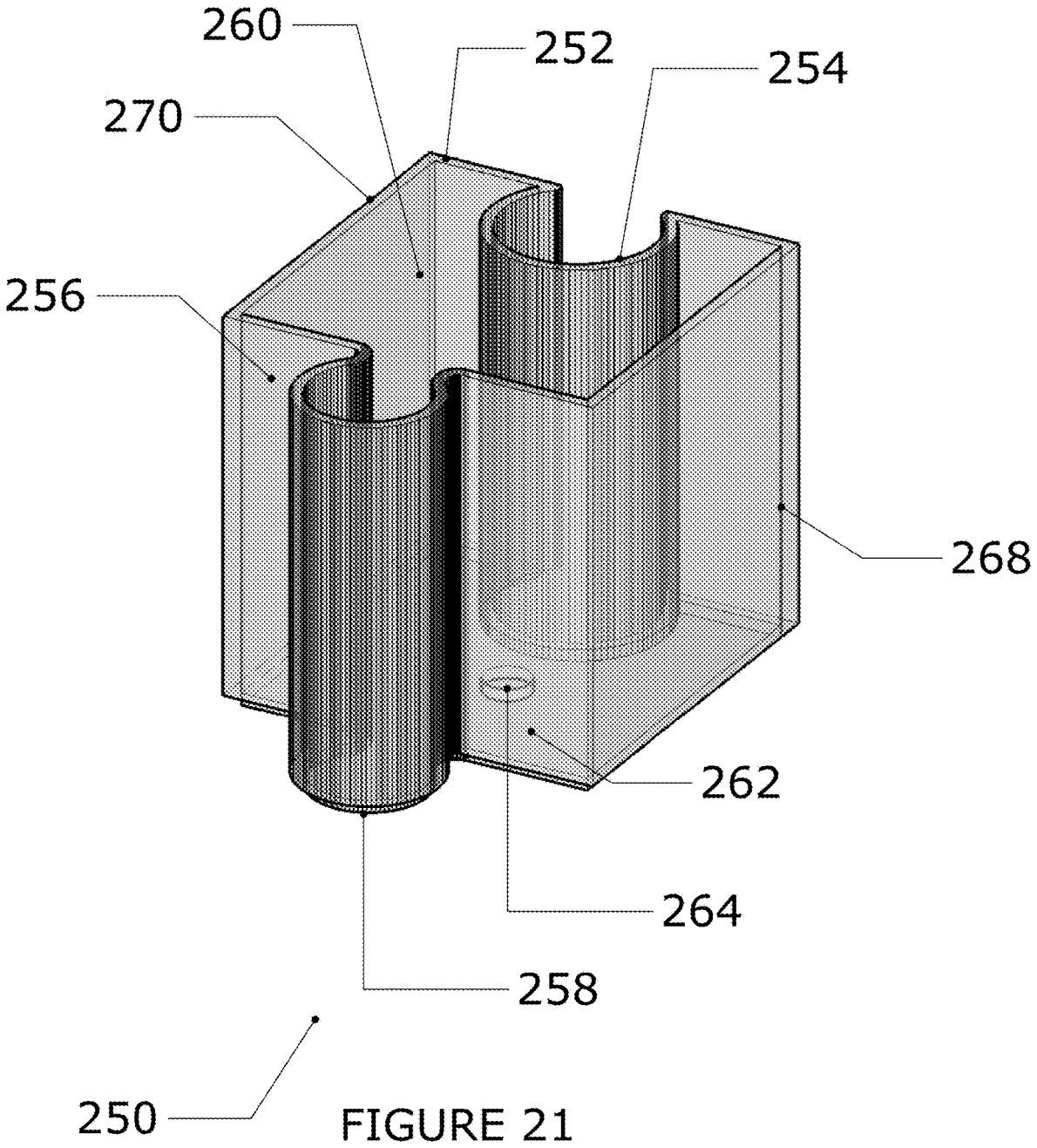
FIG. 21 is a perspective view of a Half Block with Female to Male Joint.
Figure 22:
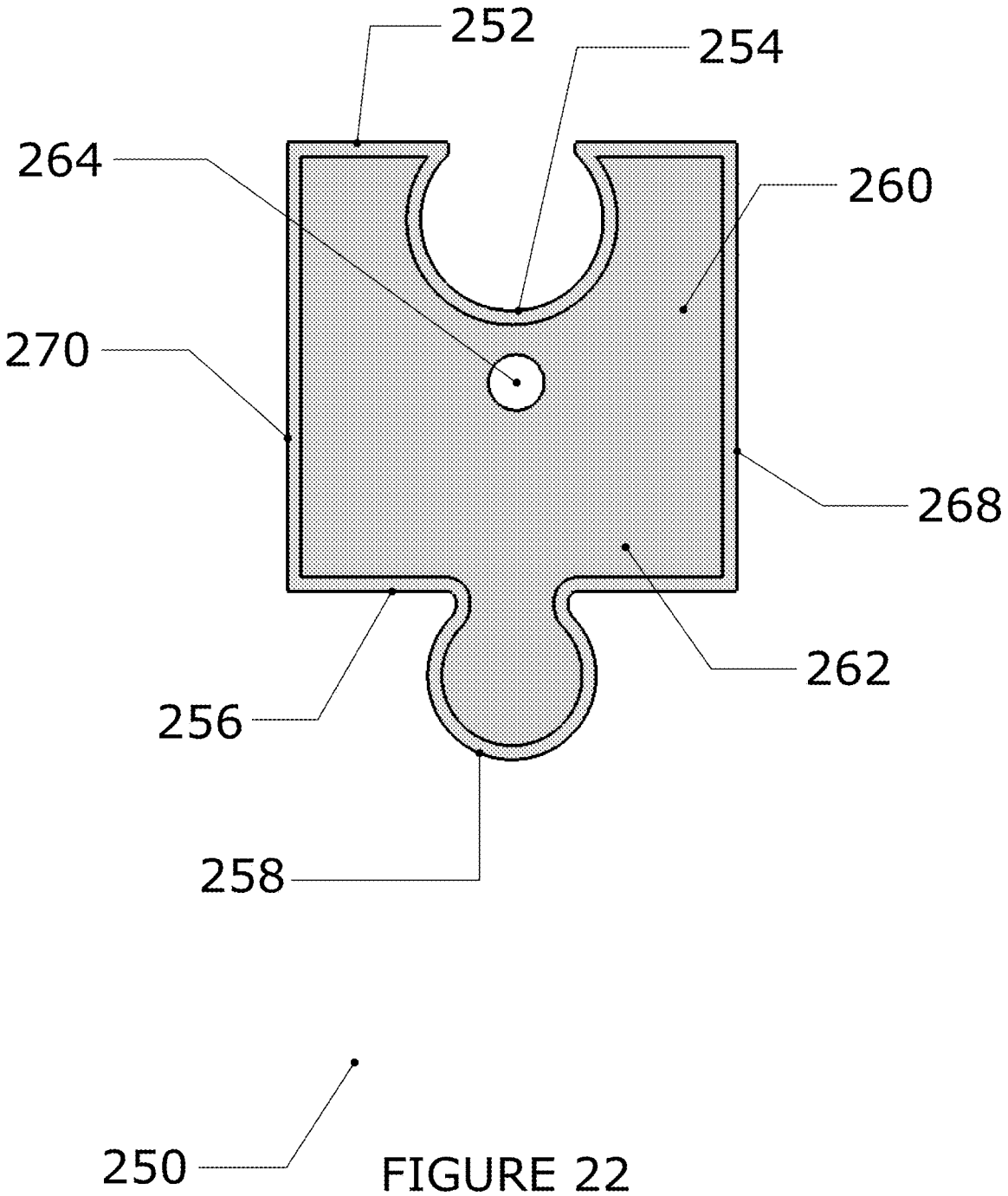
FIG. 22 is a top view of a Half Block with Female to Male Joint.

FIGS. 21 and 22 illustrate a Half Block with Female to Male Joint 250 which is the eleventh element of the building block system invention.

FIG. 21 illustrates a perspective view of a Half Block with Female to Male Joint 250 and depicts a hollow cube form that has eight 90-degree vertices.

The Half Block with Female to Male Joint 250 may be made in any dimension suitable for the building it will be forming. In the preferred embodiment, the Half Block with Female to Male Joint 250 is eight inches wide, eight inches high, and eight inches long, with eleven inches being the distance from the arc of the one male mating formation's 258 curved protuberance to the first end portion 252. In other embodiments, the Half Block with Female to Male Joint 250 has a length equal to its width and is one fourth as thick as its length.

The Half Block with Female to Male Joint 250 consists of an open top portion 260; a bottom portion 262 that is flat and closed with the exception of one guide conduit orifice 264 located in the center of the block; an unornamented front face portion 268; an unornamented rear face portion 270; a first end portion 252 that has one female mating formation 254 being a concavity; and a second end portion 256 that has one male mating formation 258 being is a curved protuberance. The unornamented front face portion 268 and the unornamented rear face portion 270 are smooth flat planar surfaces.

FIG. 22 illustrates a top view of a Half Block with Female to Male Joint 250 and shows a male mating formation 258 that is a curved protuberance running vertically up the second end portion 256, and a female mating formation 254 that is a concavity running vertically up the first end portion 252. In the preferred embodiment, the Half Block with Female to Male Joint 250 has a female mating formation 254 that is a concavity with a radius of one and five-eighths inches running vertically up the first end portion 252, and a male mating formation 258 that is a curved protuberance with a radius of one and one-fourth inches running vertically up the second end portion 256. In other embodiments, the Half Block with Female to Male Joint 250 has a concavity with a radius sufficient to couple with male mating formations that are corresponding protuberances running vertically up portions of other blocks in addition to a curved protuberance with a radius sufficient to couple with female mating formations that are corresponding concavities running vertically up portions of other blocks. In all embodiments of the Half Block with Female to Male Joint 250 the mating formations are designed so that the coupling is reversible, thereby making the block reusable.

FIG. 22 also illustrates that the Half Block with Female to Male Joint 250 has a bottom portion 262 that is closed with the exception of one guide conduit orifice 264 which cooperates to receive one or more threaded rods which pass vertically through the guide conduit orifice in order to align and reinforce the blocks so structural integrity is maintained when a series of blocks are stacked upwardly upon each other while building structures. In the preferred embodiment of the Half Block with Female to Male Joint 250, the guide conduit orifice 264 has a diameter of one and one-fourth inches. In all embodiments of the Half Block with Female to Male Joint 250, the diameter of the guide conduit orifice 264 is somewhat larger that the diameter of the threaded rod so that the threaded rod can be inserted through the guide conduit orifice 264 with some tolerance.

In addition, the block building system consists of four Cap Attachments. Each Cap Attachment caps off correspondingly shaped blocks by snapping onto the top of the block. In all embodiments, each of the four Cap Attachments are designed to be reusable and connect to correspondingly shaped blocks by inserting a pin through each access port (depicted in FIG. 31) located on the front face portion and rear face portion of the correspondingly shaped blocks. And in all embodiments, each of the four Cap Attachments has a top portion where there is located one or more guide conduit orifices (as further illustrated in FIG. 31) that cooperate to receive a threaded rod vertically inserted downward through a series of blocks stacked upwardly and two square shaped footers (as further illustrated in FIG. 31) the purpose of which are to align the blocks as each is stacked upwardly upon another other.

Figure 23:
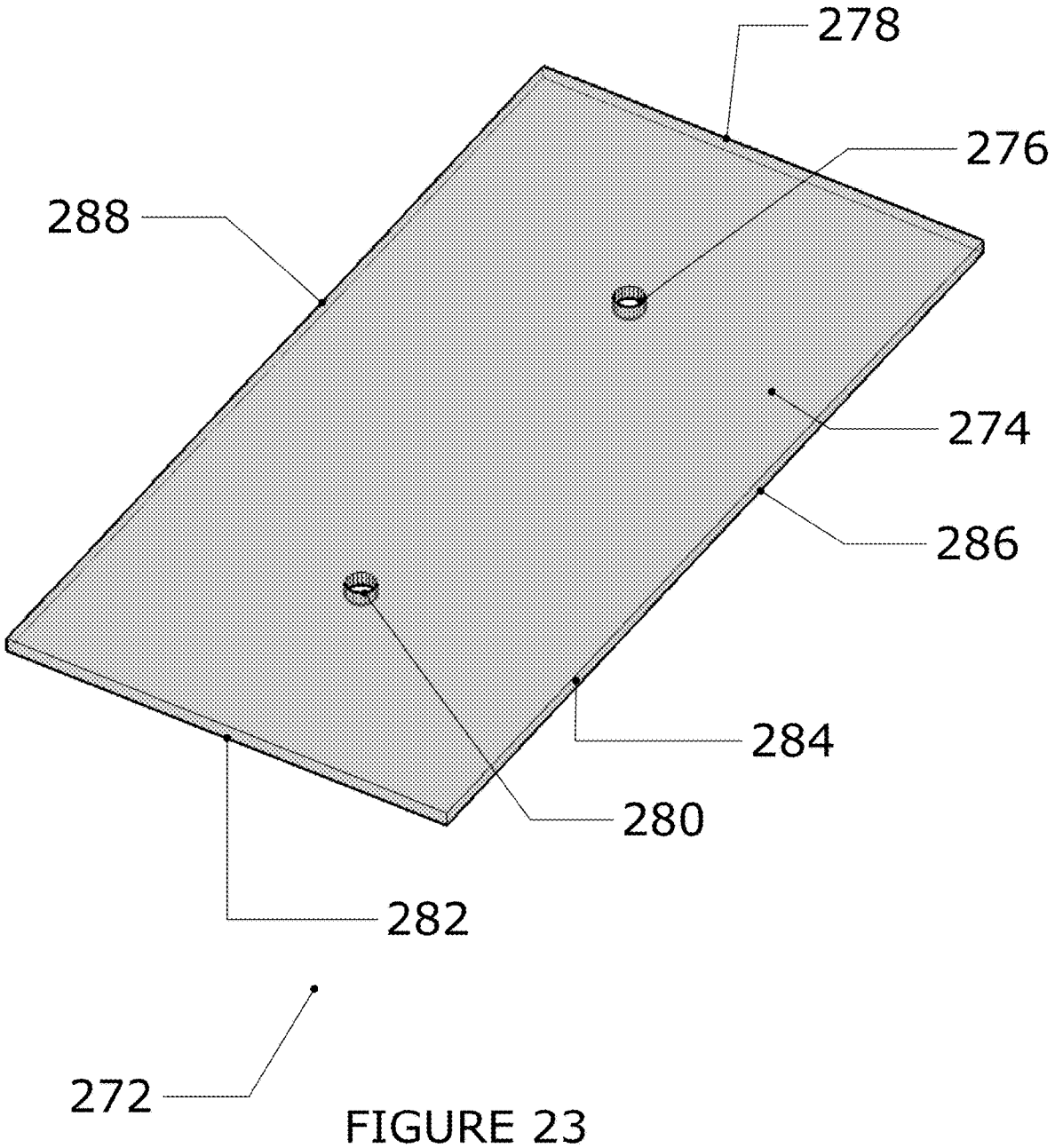
FIG. 23 is a perspective view of a Full Block Cap Attachment.
Figure 24:
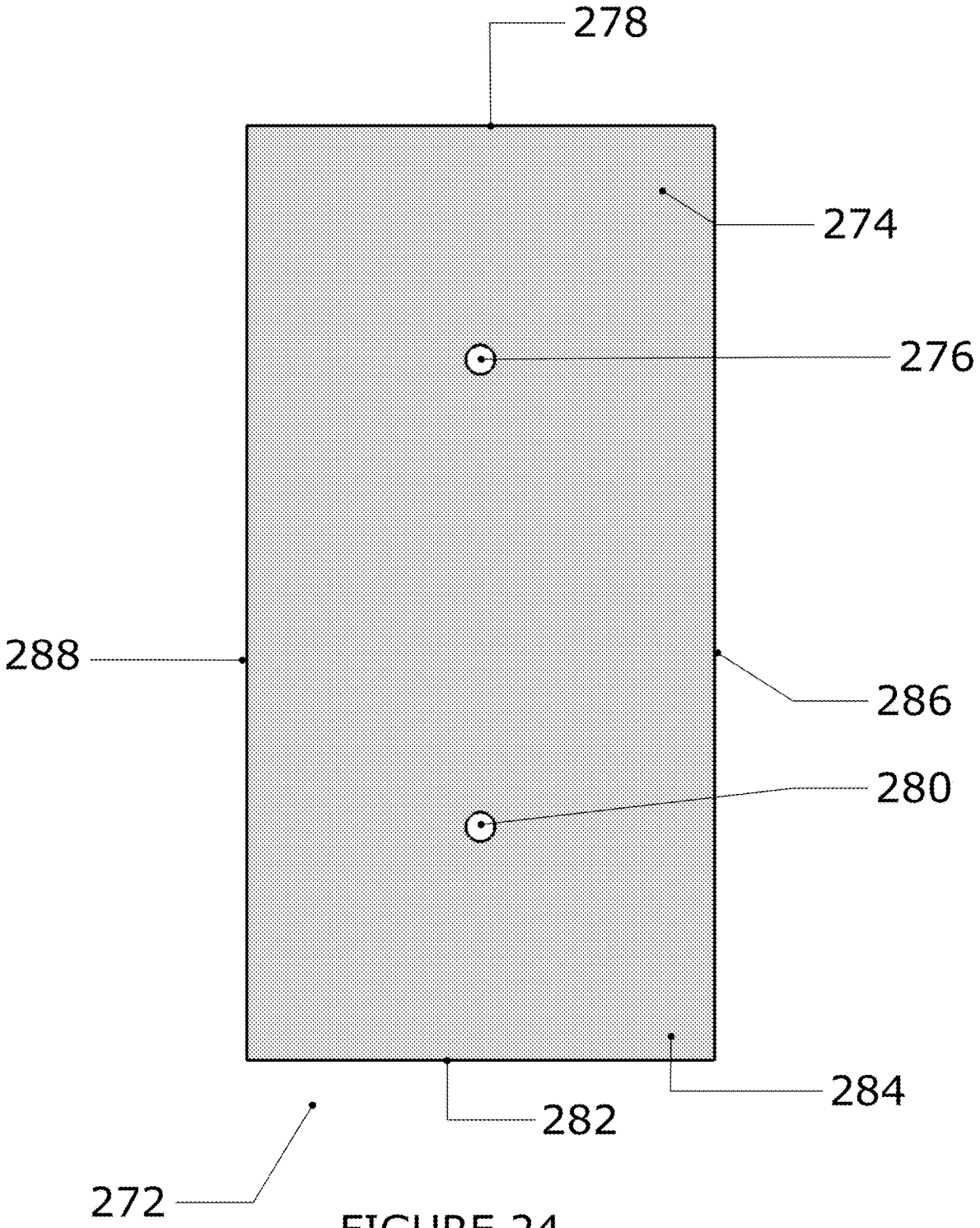
FIG. 24 is a top view of a Full Block Cap Attachment.

FIGS. 23 and 24 illustrate a Full Block Cap Attachment 272 which is the twelfth element of the building block system invention and which is used to cap off the Full End Block with Female Joint 10, the Full Corner Block with Female Joint and Offset Male Corner 50, the Full Block with Female to Male Joint 74, the Full End Block Male with Male Joint 98, and the Full Corner Block with Male Joint and Offset Female Corner 204 in order to build structures.

FIG. 23 illustrates a perspective view of a Full Block Cap Attachment 272 and depicts a hollow rectangular form that has eight 90-degree vertices. The Full Block Cap Attachment 272 may be made in any dimension suitable for capping off the Full End Block with Female Joint 10, the Full Corner Block with Female Joint and Offset Male Corner 50, the Full Block with Female to Male Joint 74, the Full End Block Male with Male Joint 98, and the Full Corner Block with Male Joint and Offset Female Corner 204. In the preferred embodiment, the Full Block Cap Attachment 272 is eight inches wide, one and one-half inches high, and sixteen inches long.

The Full Block Cap Attachment 272 consists of a top portion 274 that is closed with the exceptions of one guide conduit orifice 276 located near the first end portion 278, and one guide conduit orifice 280 located near the second end portion 282; an open bottom portion 284; an unornamented front face portion 286; an unornamented rear face portion 288; an unornamented first end portion 278; and an unornamented second end portion 282. The unornamented front face portion 286, unornamented rear face portion 288, unornamented first end portion 278, and unornamented second end portion 282 are smooth flat planar surfaces.

FIG. 24 illustrates a top view of a Full Block Cap Attachment 272. In the preferred embodiment, the Full Block Cap Attachment 272 is rectilinear on all sides and has a top portion 274 that is closed with the exceptions of two guide conduit orifices 276 and 280, each of which cooperates to receive one or more threaded rods which pass vertically through the guide conduit orifices in order to align and reinforce the blocks so structural integrity is maintained when a series of blocks are stacked upwardly upon each other while building structures. In the preferred embodiment of the Full Block Cap Attachment 272, the guide conduit orifices 276 and 280 have a diameter of one and one-fourth inches. In all embodiments of the Full Block Cap Attachment 272, the diameter of the guide conduit orifices 276 and 280 are somewhat larger that the diameter of the threaded rod so that the threaded rod can be inserted through the guide conduit orifices 276 and 280 with some tolerance.

Figure 25:
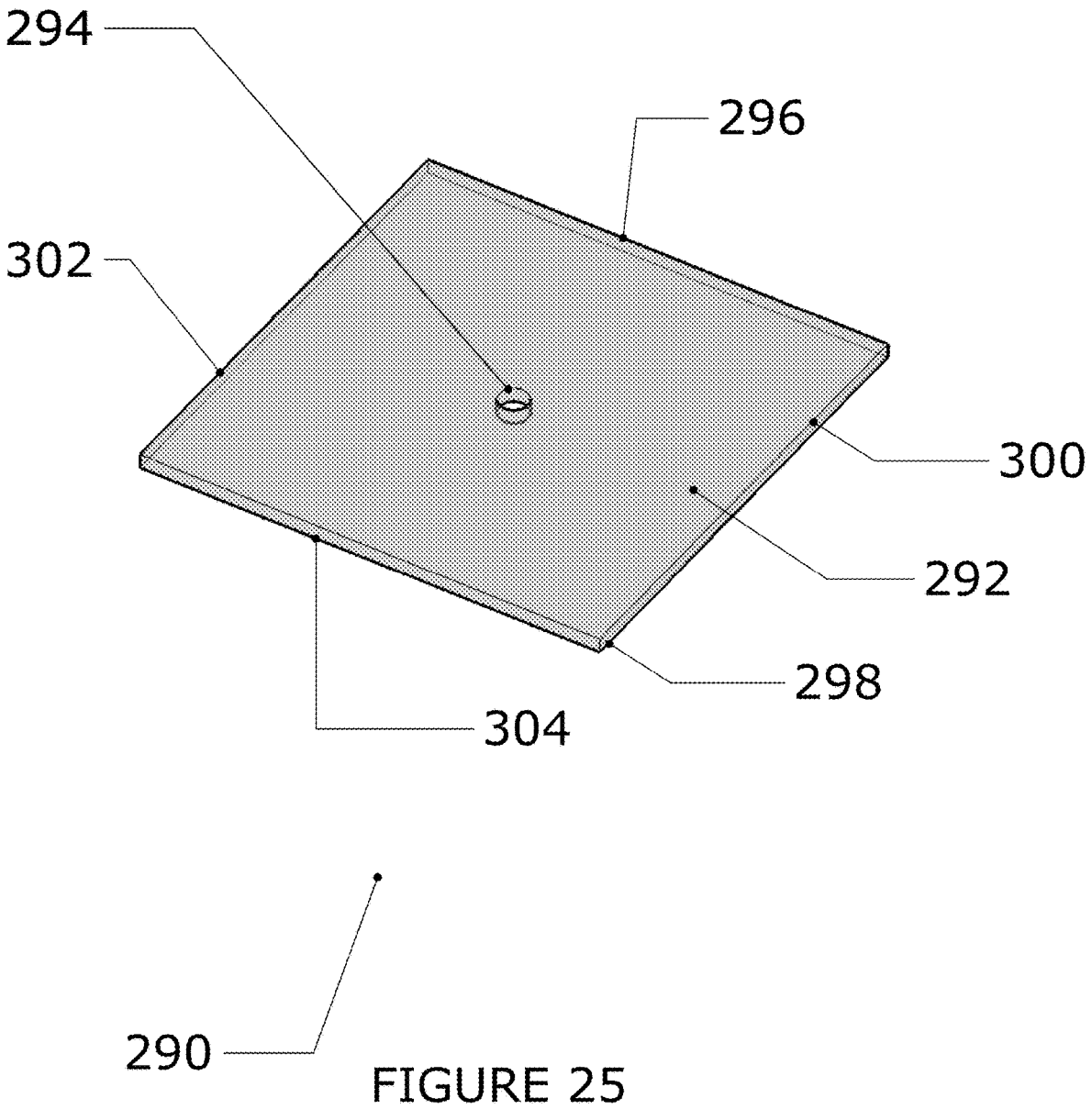
FIG. 25 is a perspective view of a Half Block Cap Attachment.
Figure 26:
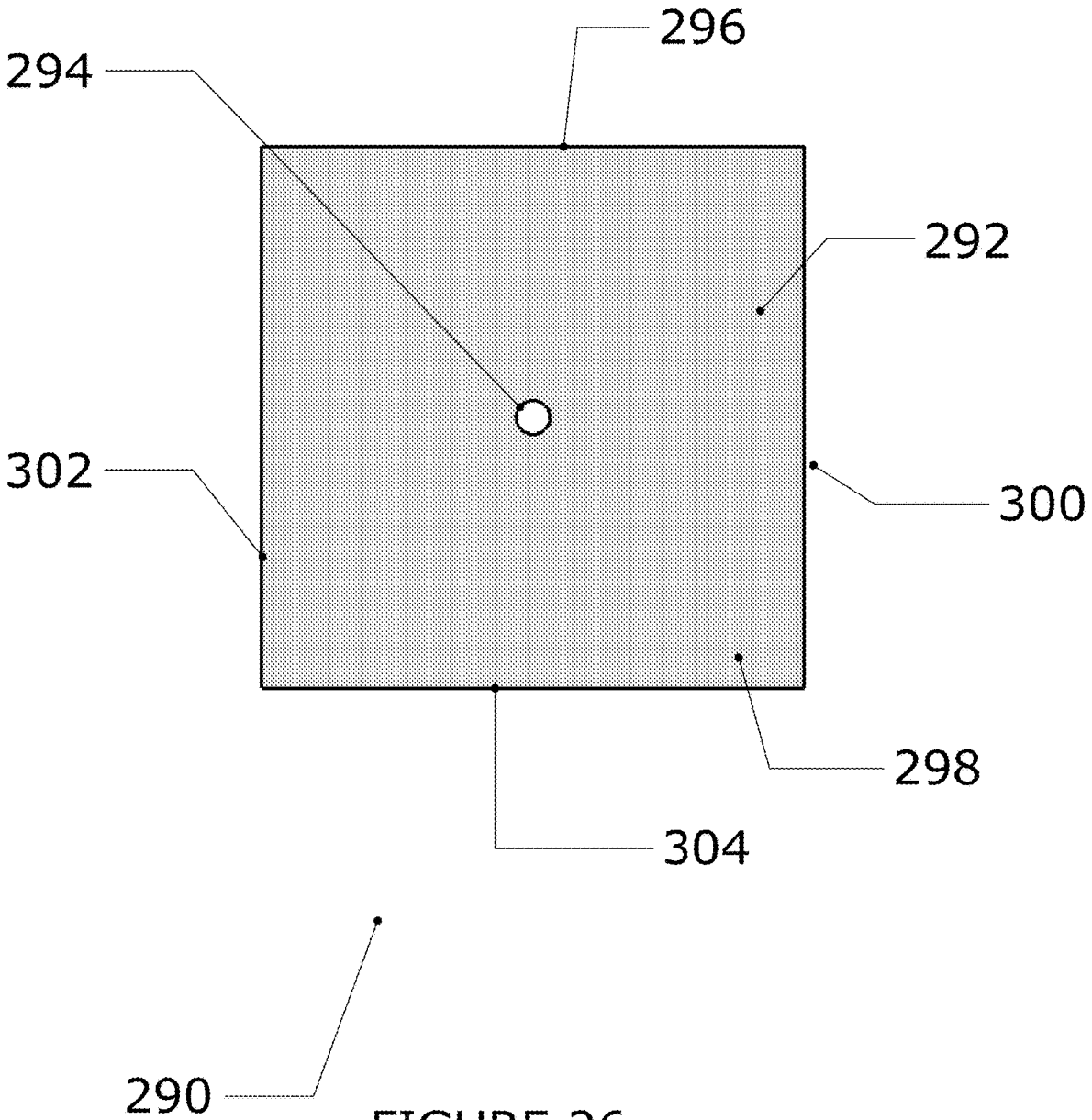
FIG. 26 is a top view of a Half Block Cap Attachment.

FIGS. 25 and 26 illustrate a Half Block Cap Attachment 290 which is the thirteenth element of the building block system invention and which is used to cap off the Half End Block with Female Joint 32, the Half End Block with Male Joint 120, the Half Corner Block with Male Joint and Offset Female Corner 228, and the Half Block with Female to Male Joint 250 in order to build structures.

FIG. 25 illustrates a perspective view of a Half Block Cap Attachment 290 and depicts a hollow square form that has eight 90-degree vertices. The Half Block Cap Attachment 290 may be made in any dimension suitable for capping off Half End Block with Female Joint 32, the Half End Block with Male Joint 120, the Half Corner Block with Male Joint and Offset Female Corner 228, and the Half Block with Female to Male Joint 250. In the preferred embodiment, the Half Block Cap Attachment 290 is eight inches wide, one and one-half inches high, and eight inches long.

The Half Block Cap Attachment 290 consists of a top portion 292 that is closed with the exception of one guide conduit orifice 294 located in the center of cap attachment; an open bottom portion 298; an unornamented front face portion 300; an unornamented rear face portion 302; an unornamented first end portion 296; and an unornamented second end portion 304. The unornamented front face portion 300, unornamented rear face portion 302, unornamented first end portion 296, and unornamented second end portion 304 are smooth flat planar surfaces.

FIG. 26 illustrates a top view of a Half Block Cap Attachment 290. In the preferred embodiment, the Half Block Cap Attachment 290 is rectilinear on all sides and has a top portion 292 that is closed with the exception of one guide conduit orifice 294 located in the center of the Half Block Cap Attachment 290 which cooperates to receive one or more threaded rods which pass vertically through the guide conduit orifice in order to align and reinforce the blocks so structural integrity is maintained when a series of blocks are stacked upwardly upon each other while building structures. In the preferred embodiment of the Half Block Cap Attachment 290, the guide conduit orifice 294 has a diameter of one and one-fourth inches. In all embodiments of the Half Block Cap Attachment 290, the diameter of the guide conduit orifice 294 is somewhat larger that the diameter of the threaded rod so that the threaded rod can be inserted through the guide conduit orifice 294 with some tolerance.

Figure 27:
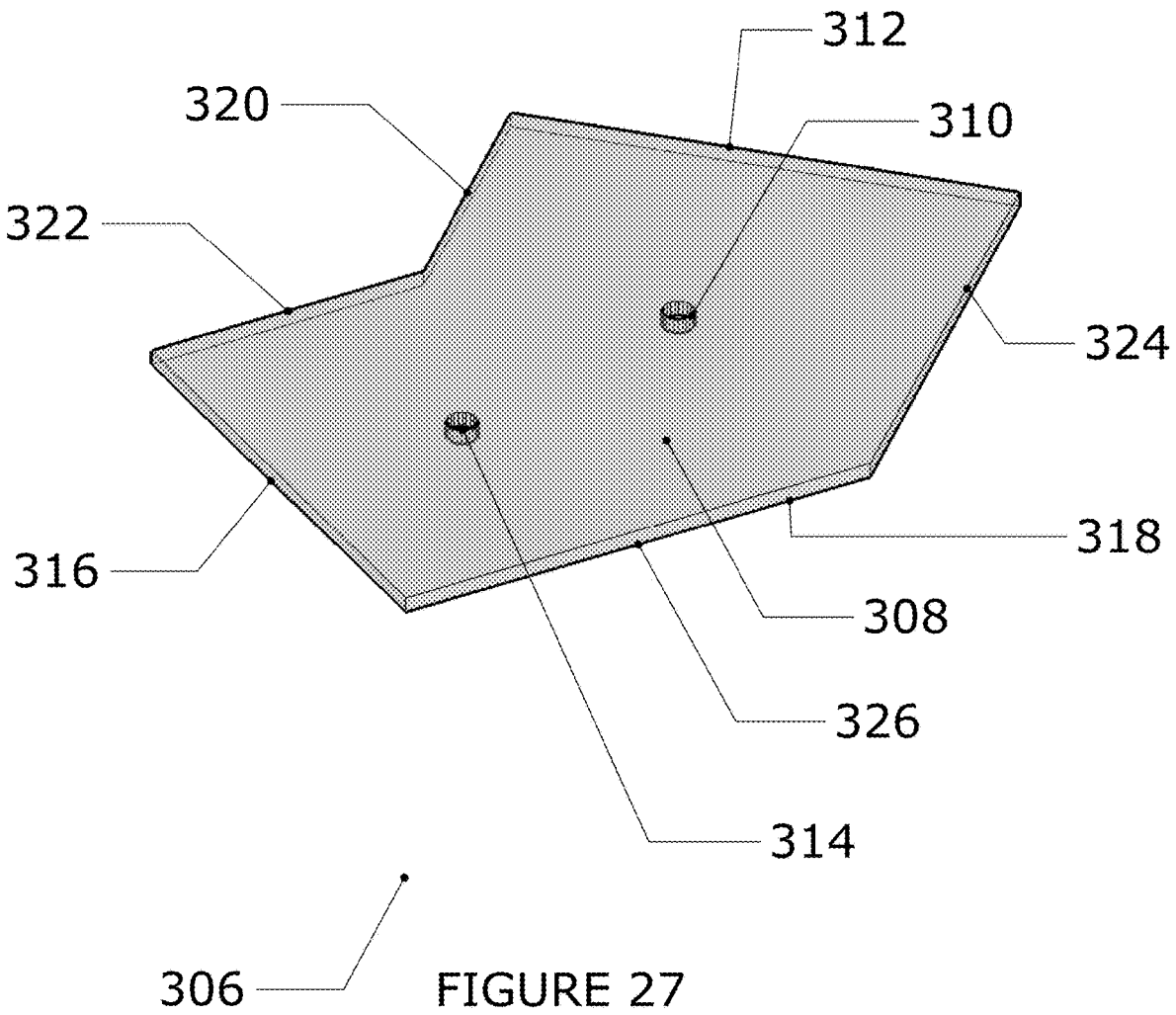
FIG. 27 is a perspective view of a 45-degree Angle Half Block Cap Attachment.
Figure 28:
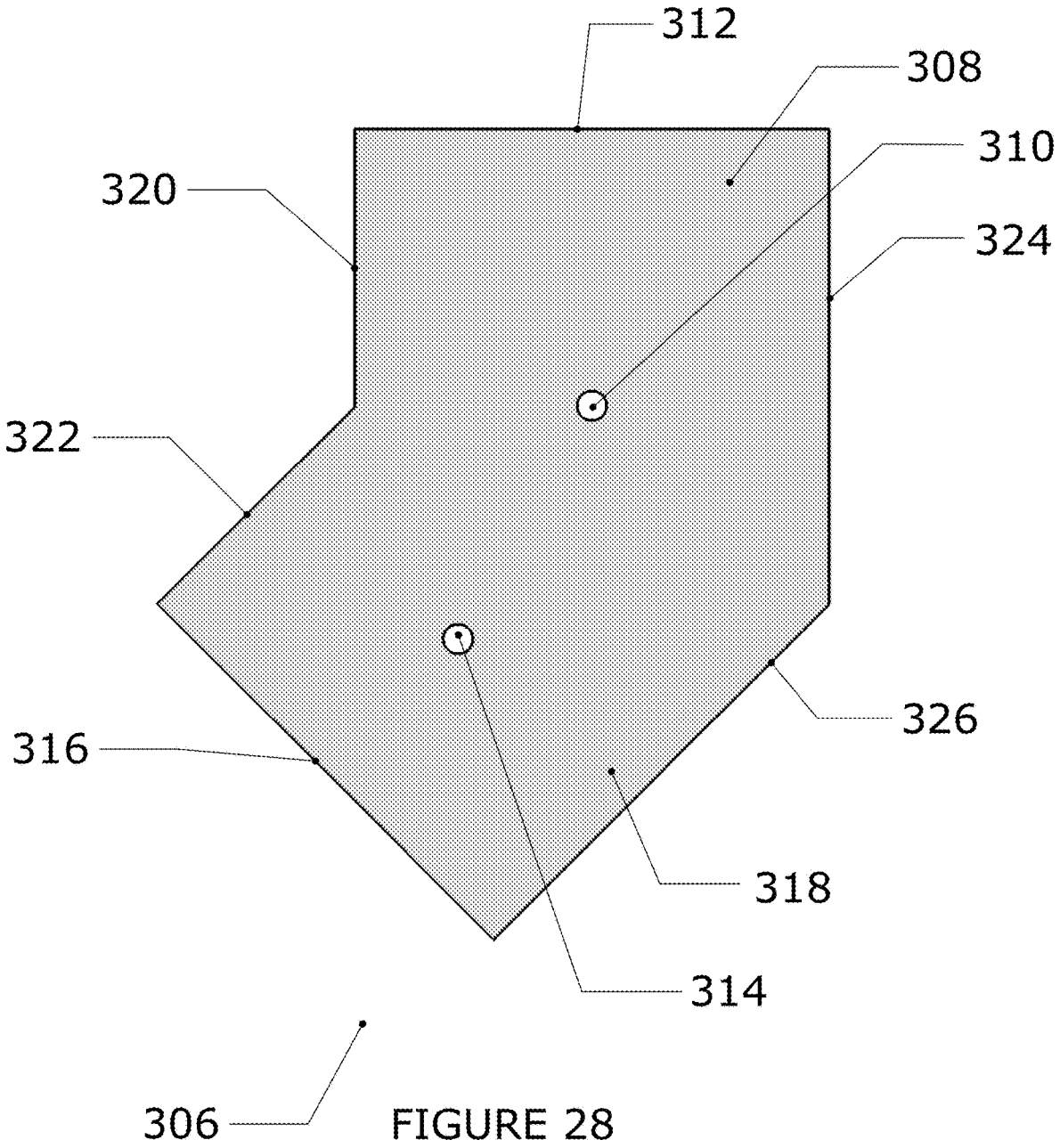
FIG. 28 is a top view of a 45-degree Angle Half Block Cap Attachment.

FIGS. 27 and 28 illustrate a 45-degree Angle Half Block Cap Attachment 306 which is the fourteenth element of the building block system invention and which is used to cap off the 45-degree Angle Half Block with a Female to Male Joint 140 in order to build structures.

FIG. 27 illustrates a perspective view of a 45-degree Angle Half Block Cap Attachment 306 and depicts an octahedron-shaped hollow form with four 45-degree vertices and eight 90-degree vertices. The 45-degree Angle Half Block Cap Attachment 306 may be made in any dimension suitable for capping off the 45-degree Angle Half Block with a Female to Male Joint 140. In the preferred embodiment, the 45-degree Angle Half Block Cap Attachment 306 is eight inches wide, one and one-half inches high, and eight inches long.

The 45-degree Angle Half Block Cap Attachment 306 consists of a top portion 308 in the shape of a concave hexagon that is closed with the exceptions of one guide conduit orifice 310 located near the first end portion 312, and one guide conduit orifice 314 located near the second end portion 316; an open bottom portion 318 in the shape of a concave hexagon; an unornamented flat upper left rear face portion 320; an unornamented flat lower left rear face portion 322 that intersects at a 45-degree angle with the upper left rear face portion 320 to form a vertex; an unornamented flat upper right front face portion 324; an unornamented flat lower right front face portion 326 that intersects at a 45-degree angle with the upper right front face portion 324 to form a vertex; an unornamented first end portion 312; and unornamented second end portion 316. The unornamented flat upper left rear face portion 320, the unornamented flat lower left rear face portion 322, the unornamented flat upper right front face portion 324, the unornamented flat lower right front face portion 326, the unornamented first end portion 312, and the unornamented second end portion 316 are smooth flat planar surfaces.

FIG. 28 illustrates a top view of a 45-degree Angle Half Block Cap Attachment 306. In the preferred embodiment, the 45-degree Angle Half Block Cap Attachment 306 is rectilinear on all sides and has a top portion 308 that is closed with the exceptions of two guide conduit orifices 310 and 314, each of which cooperates to receive one or more threaded rods which pass vertically through the guide conduit orifices in order to align and reinforce the blocks so structural integrity is maintained when a series of blocks are stacked upwardly upon each other while building structures. In the preferred embodiment of the 45-degree Angle Half Block Cap Attachment 306, the guide conduit orifices 310 and 314 have a diameter of one and one-fourth inches. In all embodiments of the 45-degree Angle Half Block Cap Attachment 306, the diameter of the guide conduit orifices 310 and 314 are somewhat larger that the diameter of the threaded rod so that the threaded rod can be inserted through the guide conduit orifices 310 and 314 with some tolerance.

Figure 29:
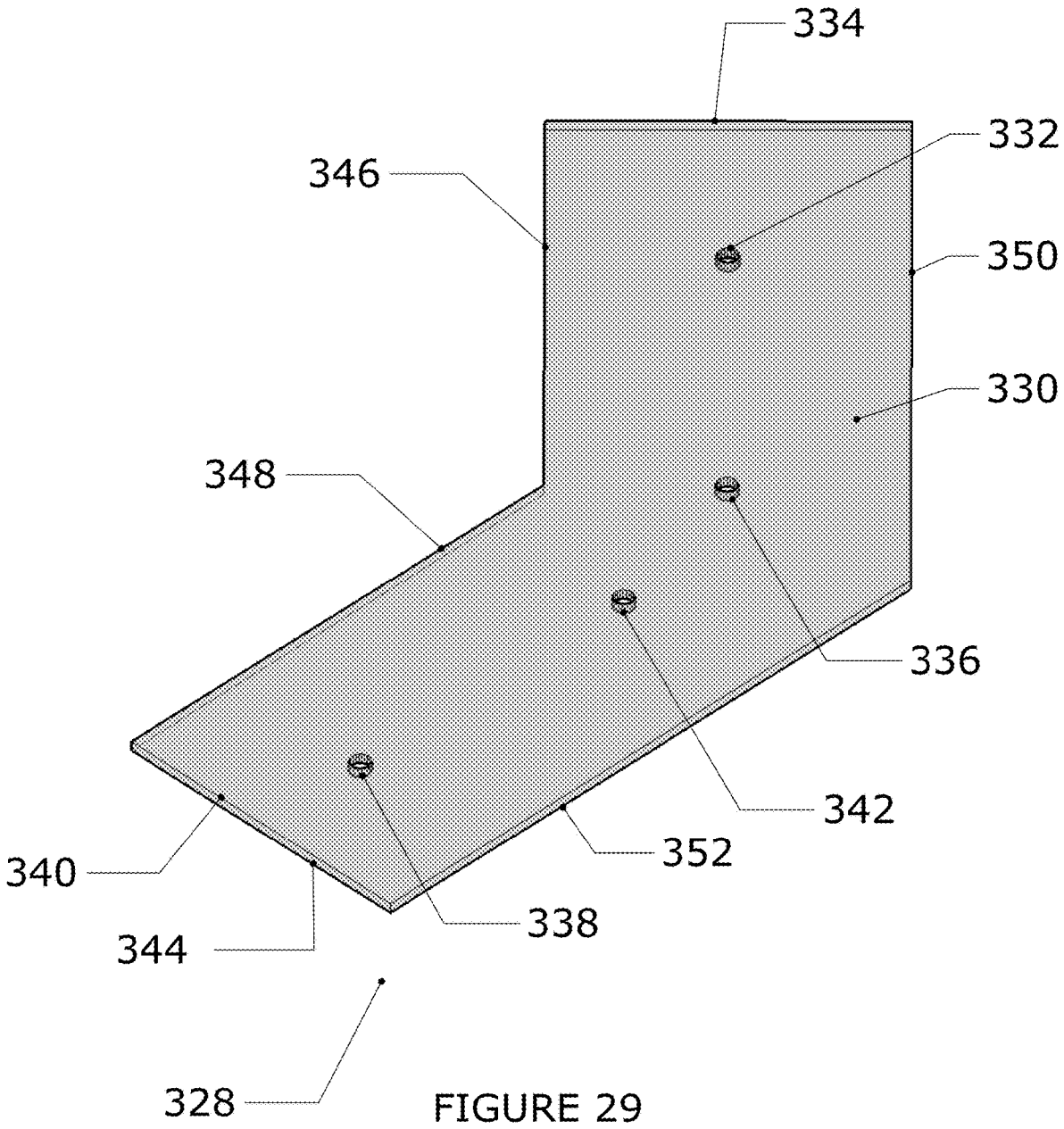
FIG. 29 is a perspective view of a 45-degree Angle Full Block Cap Attachment.
Figure 30:
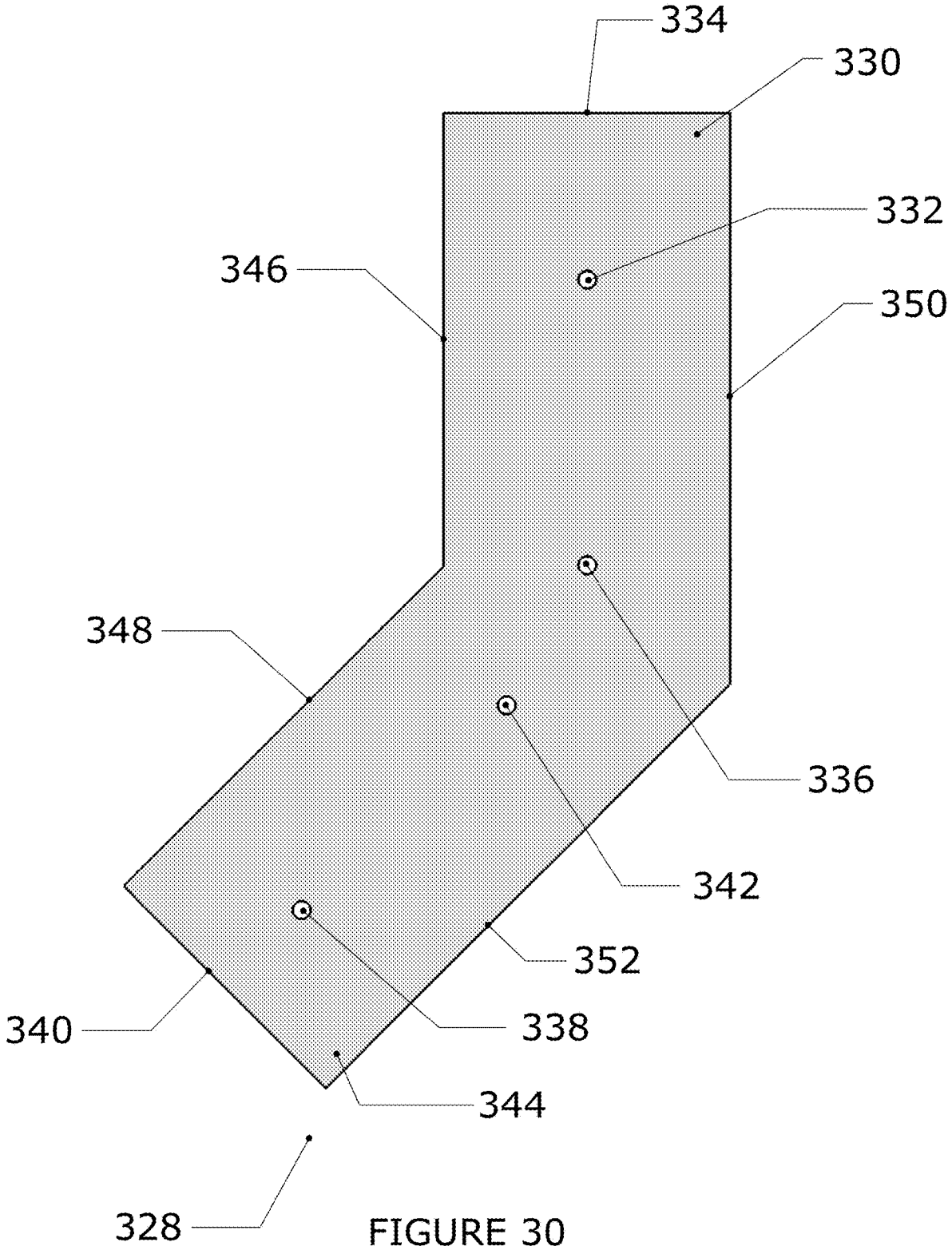
FIG. 30 is a top view of a 45-degree Angle Full Block Cap Attachment.

FIGS. 29 and 30 illustrate a 45-degree Angle Full Block Cap Attachment 328 which is the fifteenth element of the building block system invention and which is used to cap off the 45-degree Angle Full Block with a Female to Male Joint 168 in order to build structures.

FIG. 29 illustrates a perspective view of a 45-degree Angle Full Block Cap Attachment 328 and depicts an octahedron-shaped hollow form with four 45-degree vertices and eight 90-degree vertices. The 45-degree Angle Full Block Cap Attachment 328 may be made in any dimension suitable for capping off the 45-degree Angle Full Block with a Female to Male Joint 168. In the preferred embodiment, the 45-degree Angle Full Block Cap Attachment 328 is eight inches wide, one and one-half inches high, and sixteen inches long.

The 45-degree Angle Full Block Cap Attachment 328 consists of a top portion 330 in the shape of a concave hexagon that is closed with the exceptions of four guide conduit orifices 332, 336, 338 and 342; an open bottom portion 344 in the shape of a concave hexagon; an unornamented flat upper left rear face portion 346; an unornamented flat lower left rear face portion 348 that intersects at a 45-degree angle with the upper left rear face portion 346 to form a vertex; an unornamented flat upper right front face portion 350; an unornamented flat lower right front face portion 352 intersects at a 45-degree angle with the upper right front face portion 350 to form a vertex; an unornamented first end portion 334; and unornamented second end portion 340. The unornamented flat upper left rear face portion 346, the unornamented flat lower left rear face portion 348, the unornamented flat upper right front face portion 350, the unornamented flat lower right front face portion 352, the unornamented first end portion 334, and the unornamented second end portion 340 are smooth flat planar surfaces.

FIG. 30 illustrates a top view of a 45-degree Angle Full Block Cap Attachment 328. In the preferred embodiment, the 45-degree Angle Full Block Cap Attachment 328 is rectilinear on all sides and has a top portion 330 that is closed with the exceptions of four guide conduit orifices 332, 336, 338 and 342, each of which cooperates to receive one or more threaded rods which pass vertically through the guide conduit orifices in order to align and reinforce the blocks so structural integrity is maintained when a series of blocks are stacked upwardly upon each other while building structures. In the preferred embodiment of the 45-degree Angle Full Block Cap Attachment 328, the four guide conduit orifices 332, 336, 338 and 342 have a diameter of one and one-fourth inches. In all embodiments of the 45-degree Angle Full Block Cap Attachment 328, the diameter of the four guide conduit orifices 332, 336, 338 and 342 are somewhat larger that the diameter of the threaded rod so that the threaded rod can be inserted through the guide conduit orifices 332, 336, 338 and 342 with some tolerance.

Figure 31:
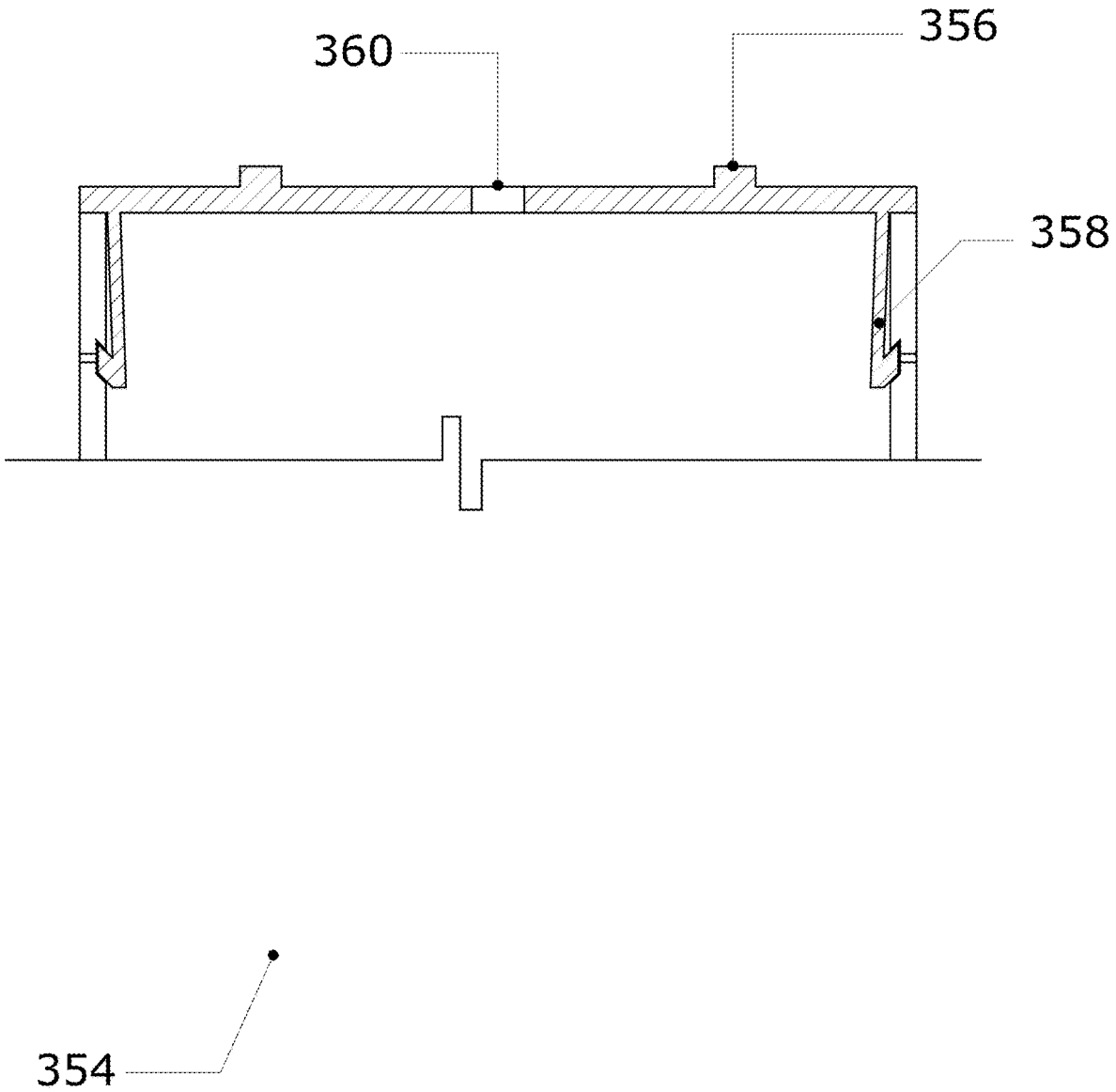
FIG. 31 is a front view of a Cap Attachment.

FIG. 31 illustrates a front view of a Cap Attachment 354. In all embodiments, each of the four Cap Attachments are designed to be reusable and connect to correspondingly shaped blocks by inserting a pin through each access port 358 located on the front face portion and rear face portion of the correspondingly shaped blocks. Furthermore, in all embodiments each of the four Cap Attachments has a top portion where there is located one or more guide conduit orifices 360 that cooperate to receive a threaded rod vertically inserted downward through a series of blocks stacked upwardly. And in all embodiments, each of the four Cap Attachments has two square shaped footers 356 the purpose of which are to align the blocks as each is stacked upwardly upon another other.

Figure 32:
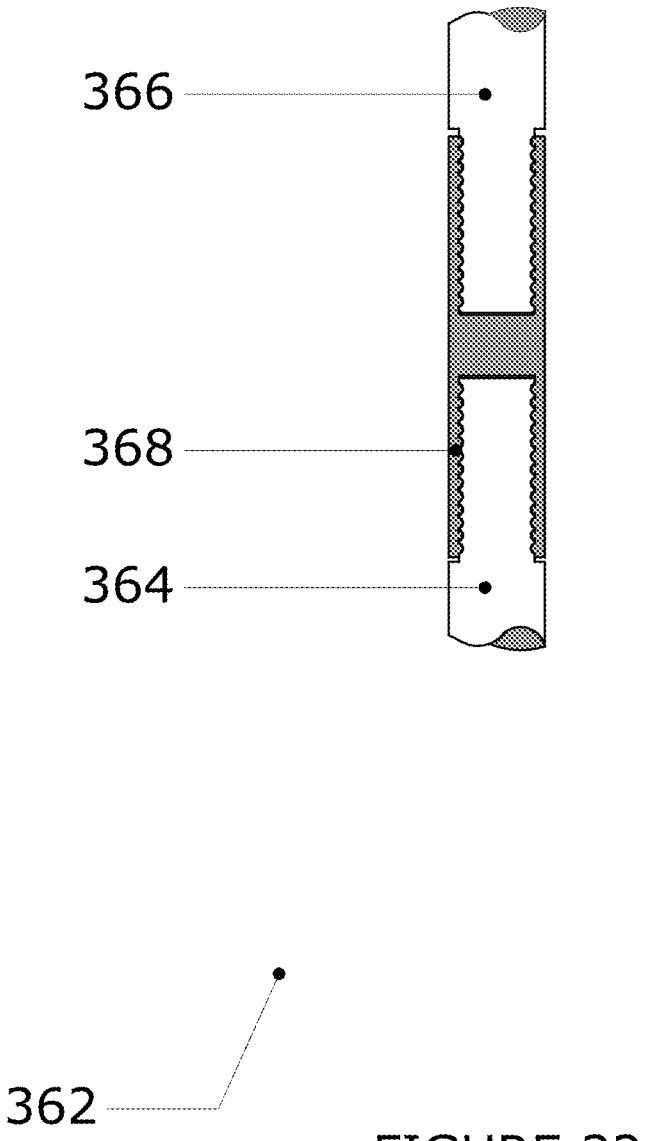
FIG. 32 is a front view of two threaded reinforcement rods inserted into a threaded coupling.

FIG. 32 illustrates a front view of a housing 362 which is a threaded coupling 368 that connects reinforcement rods 364 and 366 in a series until the desired length is achieved.

Figure 33:
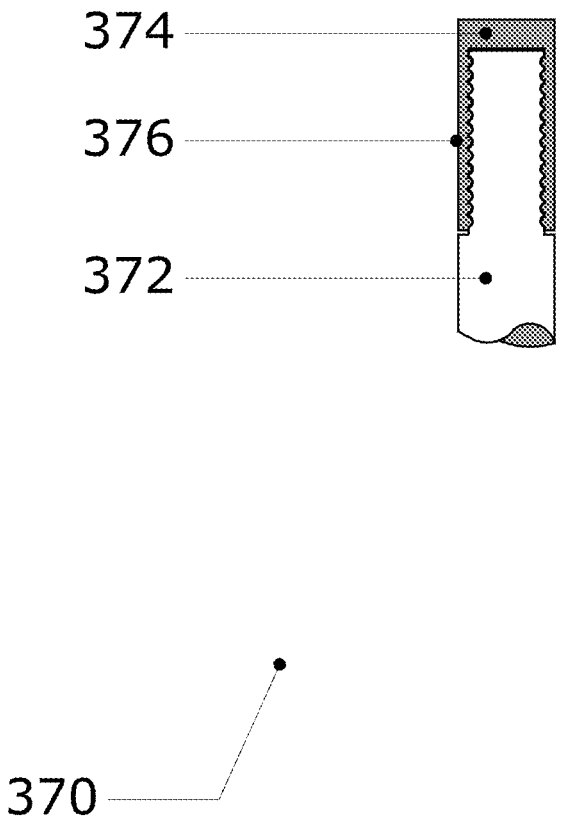
FIG. 33 is a front view of a threaded rod inserted into a threaded coupling housed in a Cap Attachment.

FIG. 33 illustrates a front view of a housing 370 which is a threaded coupling 376 with the threaded reinforcement rod 372 terminating in a cap attachment 374.

Figure 35:
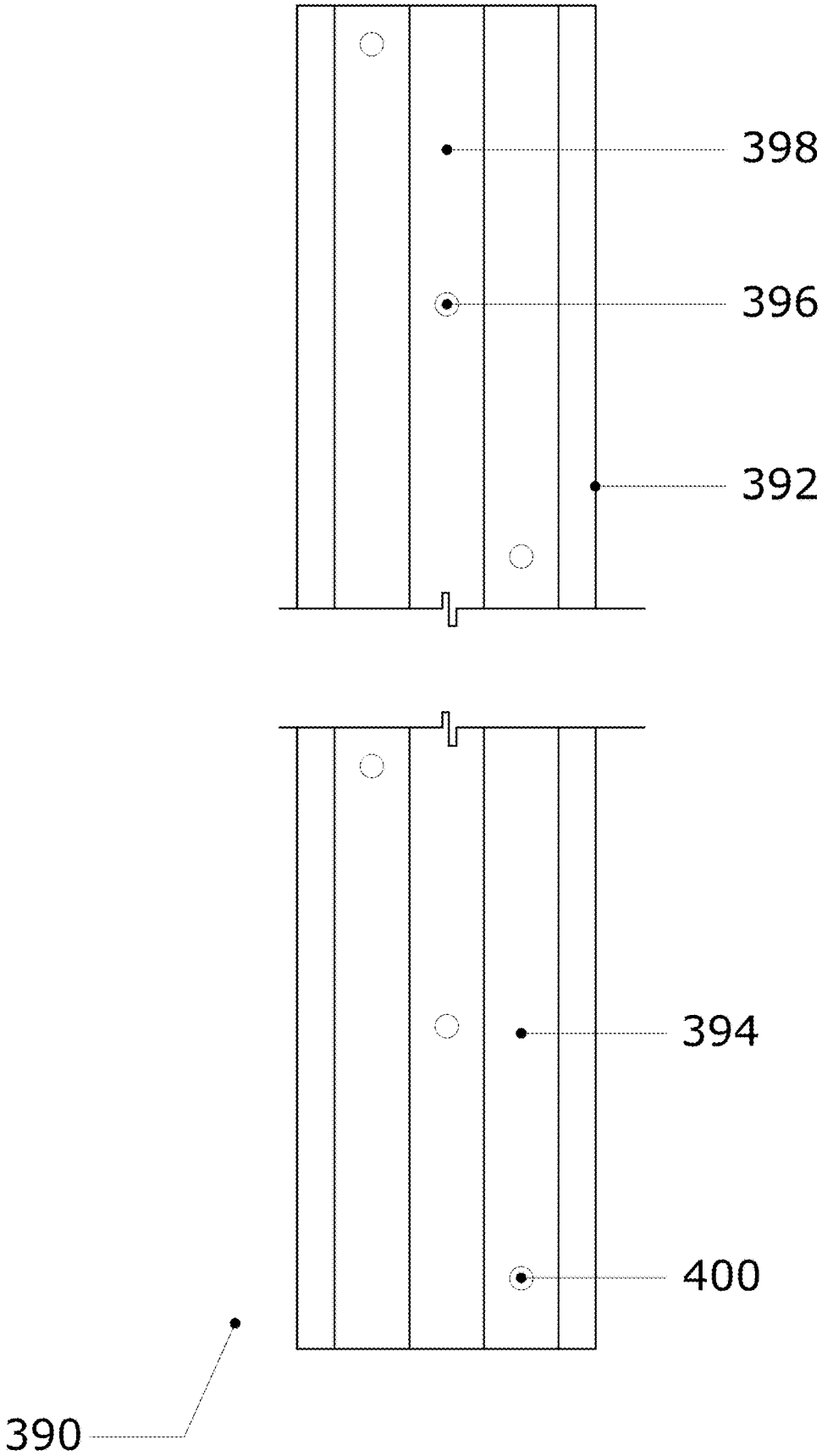
FIG. 35 shows the top view of the Foundation Component.

FIG. 35 illustrates a top view of the Foundation Component 390. The Foundation Component may be made of galvanized steel or any other material that is sufficiently lightweight, rigid, and durable enough to be reusable and strong enough to support the weight of a series of Building Blocks stacked upwardly upon each other in a staggered manner.

In the preferred embodiment, the Foundation Component 390 is eight inches wide, one and one-half inches high, and ninety-six inches long with channels 392, 394, and 398 where there are located one circular opening 396 located in the center of the Foundation Component 390 for inserting standard block bolts that affix the foundation component to the Building Blocks and two guide conduit orifices 400 with a radius of five-eighths inches located on opposite ends of the Foundation Component 390 each of which allow the threaded reinforcement rods to pass upward from the earth through the series of Building Blocks stacked upon each other in a staggered manner.

Figure 36:
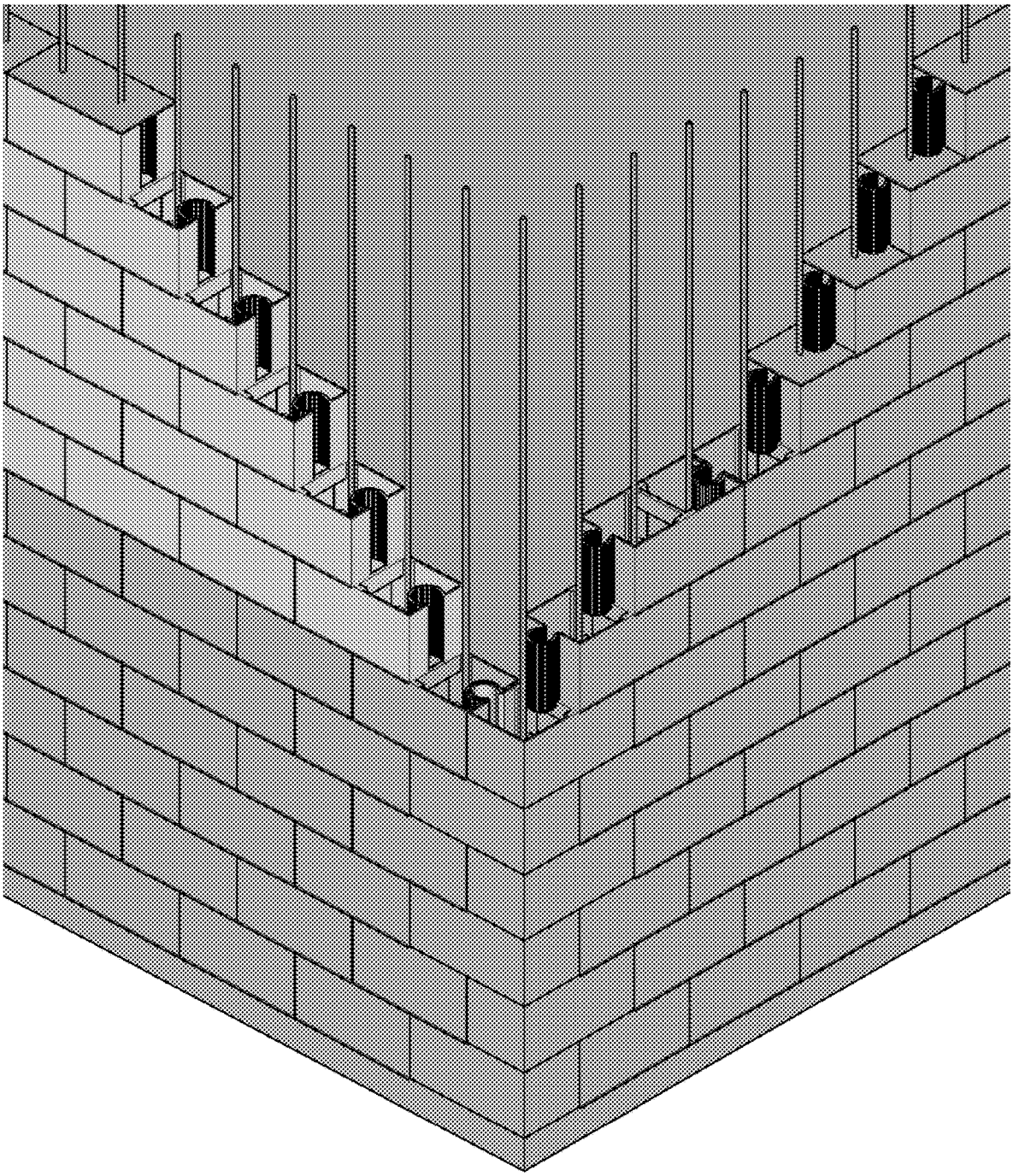
FIG. 36 is a perspective view of a cross section of a wall built using the eleven Building Blocks and four Cap Attachments.

FIG. 36 is a perspective view of a cross section of a wall built with the building system elements that consist of the eleven Building Blocks and four Cap Attachments. And FIG. 37 is a perspective view of a partially built four-walled structure constructed using the building system elements that consist of the eleven Building Blocks and four Cap Attachments and further illustrates the placement of threaded reinforcement rods.

Figure 34:
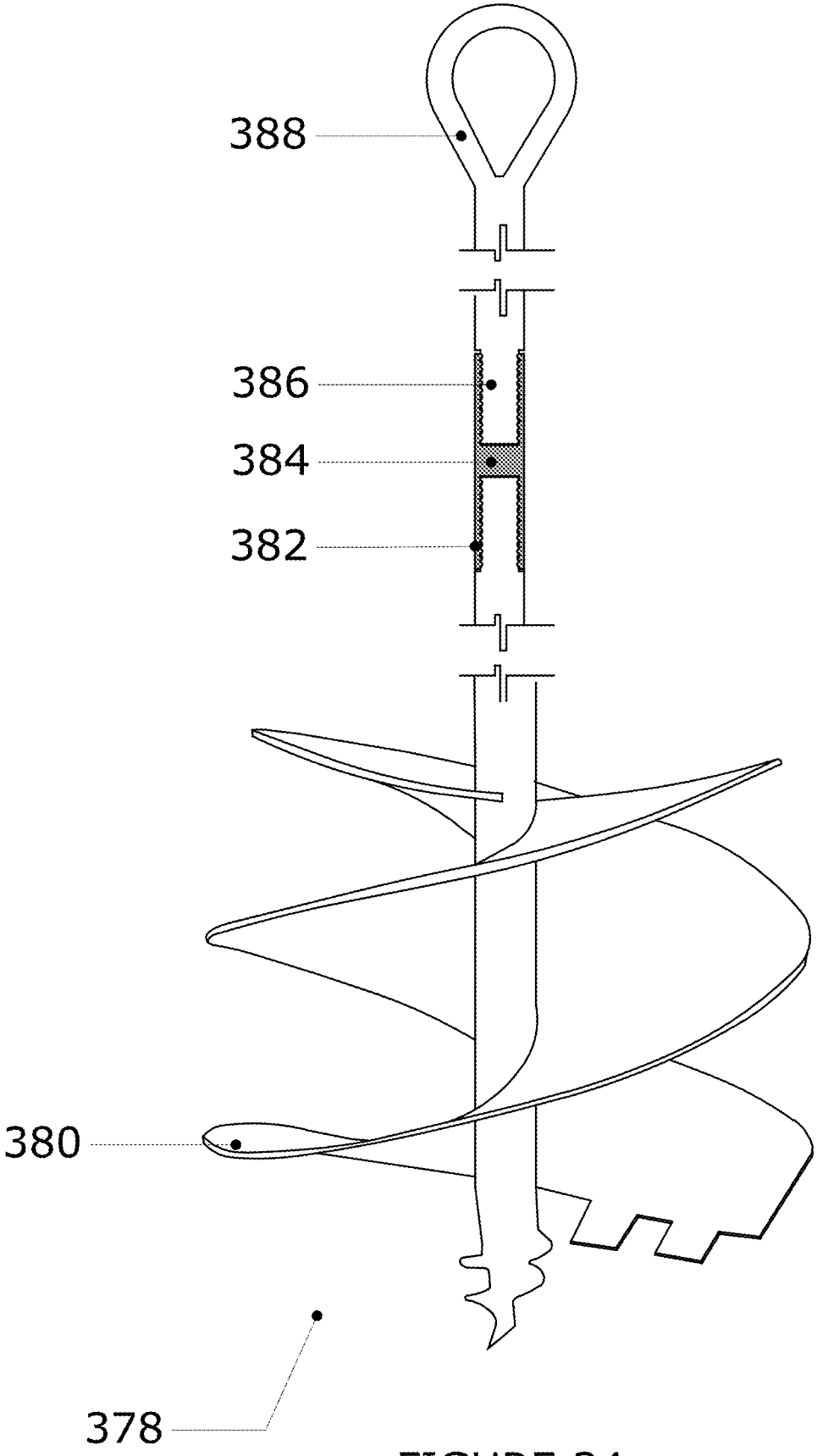
FIG. 34 is a is a front view of a threaded eye bolt, threaded coupling, and a threaded auger bit.
Figure 37:
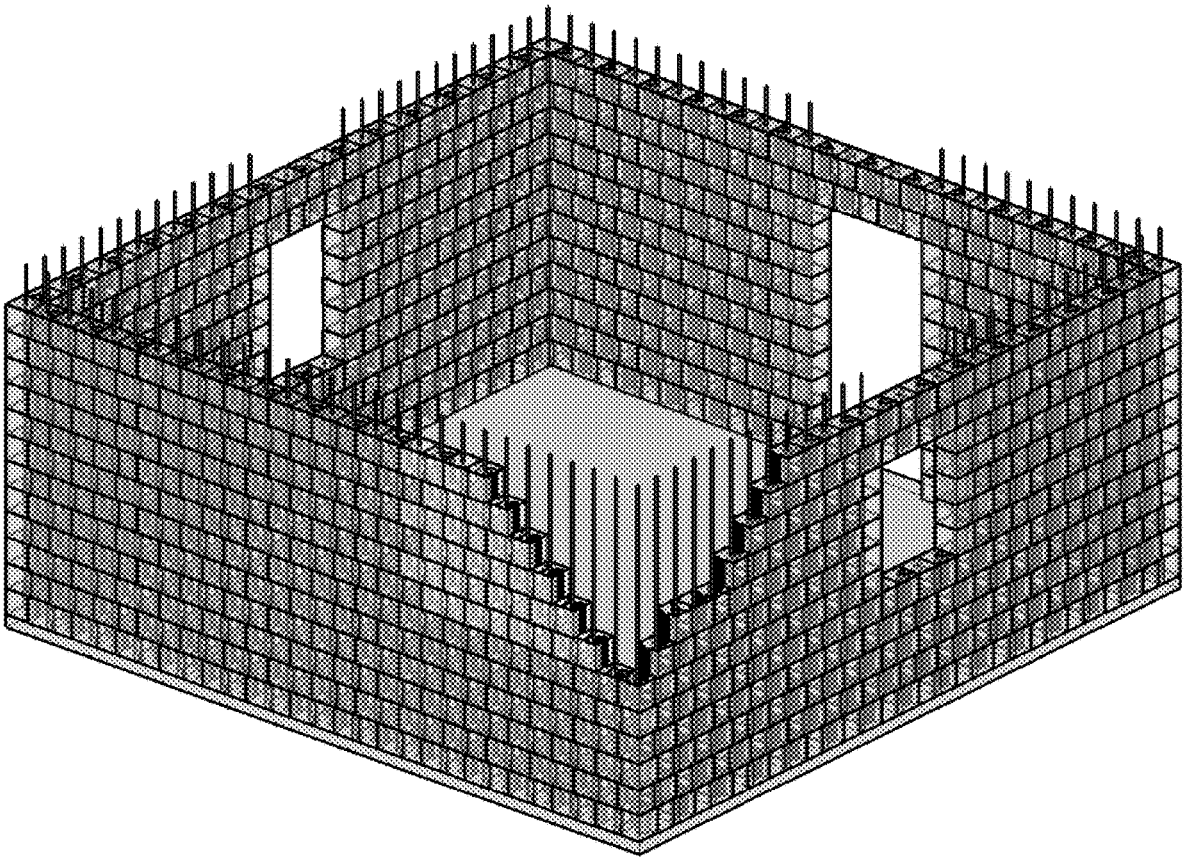
FIG. 37 a perspective view of a partially built four-walled structure constructed from the eleven Building Blocks and four Cap Attachments with placement of threaded reinforcement rods.

As generally illustrated in FIGS. 36 and 37, one method for constructing a partition, wall, or other structure using the eleven Building Blocks and four Cap Attachments is described as follows. In order to erect a partition, wall, or other structure, an auger 378 as shown in FIG. 34 is used to drill holes into the earth every eight inches for as many feet as the length of the structure to be built. The auger 378 depicted in FIG. 34 has a top portion 386 where there is located a threaded eyebolt 388 that connects to the bottom portion 380 by inserting each threaded rod 382 and 386 end into a threaded coupling 384. Twenty-four inch tall threaded reinforcement rods are inserted and secured into those holes drilled in the earth. In order to be able to connect the Building Blocks to each other so that a building is achieved, each Building Block has one or more guide conduit orifices in its bottom portion. Next, a Full Corner Block with Female Joint and Offset Male Corner 50, which has two guide conduit orifices 68 and 70 in its bottom portion 66, is brought over the top of the twenty-four inch tall threaded reinforcement rods so that the reinforcement rods run through each guide conduit orifice 68 and 70 in the bottom portion 66 of the Full Corner Block with Female Joint and Offset Male Corner 50. Using the same method, Full Block with Female to Male Joint 74 is laid and connected end-to-end with other Full Block with Female to Male Joint 74 or Half Block with Female to Male Joint 250 until the desired length of the structure is achieved. The series of Full Block with Female to Male Joint 74 or Half Block with Female to Male Joint 250 may be terminated with the Full End Block with Female Joint 10, the Full End Block with Male Joint 98, the Half End Block with Female Joint 32, or the Half End Block with Male Joint 120, or a variety of other types of angles, including 90-degree angles and other than right angles, may be formed using the other Building Blocks. The male and female mating formations on each Building Block are configured to interlock with the corresponding male and female mating formations of adjacent Building Blocks. After one course is laid, each block is filled with sand or dirt and a corresponding Cap Attachment is snapped onto each Building Block. The first course of Building Blocks must be placed on a suitably level foundation in order to cause adjacent Building Blocks to be aligned with one another along a straight line. Thereafter, a second course of Building Blocks is mounted on the first course such that each block in the second course will be staggered relative to the lower course. This method is repeated until the desired height of the partition, wall, or other structure is achieved.

We claim:

1. A modular building block system having configurable premolded interlocking building block components consisting of:

(a) a full end block with a first female joint;
(b) a half end block with a second female joint;
(c) a full block with a first female to male joint;
(d) a half block with a second female to male joint;
(e) a full end block with a first male joint;
(f) a half end block with a second male joint;
(g) a full corner block with a first male joint and offset female corner;
(h) a full corner block with a female joint and offset male corner;
(i) a half corner block with a second male joint and offset female corner;
(j) a 45-degree angle half block with a third female to male joint;
(k) a 45-degree angle full block with a fourth female to male joint;
(l) a full block cap attachment;
(m) a half block cap attachment;
(n) a 45-degree angle half block cap attachment;
(o) a 45-degree angle full block cap attachment; and
(p) a foundation component;

each of said premolded interlocking building block components comprising:

an open top portion for receiving selected materials; and four spaced, parallel, upright sidewall portions; and a flat bottom portion including one or more guide conduit orifices that have a diameter of one and one-fourth inches located in the center of the building block components to receive one or more threaded rods which pass vertically through said guide conduit orifices down to the foundation component; and wherein one or more of said sidewall portions have block-interlocking means consisting essentially of one male mating formation that is a curved protuberance with a radius of one and one-fourth inches, or one female mating formation that is a concavity with a radius of one and five-eighths inches, which said mating portions interlock with the corresponding male and female mating formations of adjacent building block components; and wherein each of the said eleven premolded interlocking building block components have four corresponding cap attachments consisting essentially of:

four spaced, parallel, upright sidewalls having flat top and open bottom surfaces, said sidewalls include an access port located on the front face sidewall portion and rear face sidewall portion and further include two or more square shaped footers that align the building block components as each is stacked upwardly upon another other.

* * * * *